US007328531B2

(12) United States Patent
Dietz

(10) Patent No.: US 7,328,531 B2
(45) Date of Patent: Feb. 12, 2008

(54) GUN SIGHT AND METHOD FOR HITTING A MOVING TARGET

(76) Inventor: Gregory D. Dietz, 1535 120th La., NE., Blaine, MN (US) 55449

( * ) Notice: Subject to any disclaimer, the term of this patent is extended or adjusted under 35 U.S.C. 154(b) by 429 days.

(21) Appl. No.: 10/674,953

(22) Filed: Sep. 29, 2003

(65) Prior Publication Data

US 2005/0086848 A1 Apr. 28, 2005

(51) Int. Cl.
*F41G 3/14* (2006.01)

(52) U.S. Cl. ..... 42/141; 42/133

(58) Field of Classification Search ..... 42/124, 42/130, 133, 113, 141, 112
See application file for complete search history.

(56) References Cited

U.S. PATENT DOCUMENTS

| | | | | | |
|---|---|---|---|---|---|
| 1,421,553 | A | * | 7/1922 | Pohl | 42/141 |
| 1,428,389 | A | | 9/1922 | Miller | |
| 1,835,938 | A | | 12/1931 | Ewen | |
| 1,901,399 | A | * | 3/1933 | Lyman, Jr. | 42/130 |
| 2,049,496 | A | | 8/1936 | Gaty | |
| 2,056,469 | A | * | 10/1936 | King | 42/140 |
| 2,061,017 | A | | 11/1936 | Arden | |
| 2,586,807 | A | | 2/1952 | Fowler | |
| 2,671,966 | A | * | 3/1954 | Jacobsen et al. | 42/137 |
| 2,741,029 | A | | 4/1956 | Councill | |
| 2,904,888 | A | | 9/1959 | Niesp | |
| 3,112,566 | A | * | 12/1963 | Jones | 42/111 |
| 3,178,824 | A | | 4/1965 | Callihoe | |
| 3,392,450 | A | * | 7/1968 | Herter et al. | 42/122 |
| 3,886,667 | A | | 6/1975 | Rueb | 33/233 |
| 4,112,583 | A | * | 9/1978 | Castilla | 42/141 |
| 4,392,723 | A | | 7/1983 | Gehmann | 350/407 |
| 4,584,776 | A | * | 4/1986 | Shepherd | 42/122 |
| 4,787,739 | A | * | 11/1988 | Thomas | 356/4.03 |
| 4,837,937 | A | * | 6/1989 | Hasselbusch | 42/137 |
| 4,850,113 | A | | 7/1989 | Doll | 33/233 |
| 4,875,290 | A | * | 10/1989 | Finch | 33/265 |
| 5,491,546 | A | * | 2/1996 | Wascher et al. | 356/4.03 |
| D376,406 | S | | 12/1996 | Rosén et al. | D22/109 |
| 5,920,995 | A | * | 7/1999 | Sammut | 42/122 |
| 6,321,479 | B1 | | 11/2001 | Sheehan | 42/100 |

* cited by examiner

*Primary Examiner*—Stephen M Johnson
(74) *Attorney, Agent, or Firm*—Charles A. Lemaire; Lemaire Patent Law Firm, P.L.L.C.

(57) ABSTRACT

A method and apparatus for configured to be attached to a gunbarrel of a firearm helping to aim at a moving target. The gun sight includes different-sized sight indicators including a first sight indicator located to be closer to the gunbarrel, and a second sight indicator, smaller than the first sight indicator and located to be further from the gunbarrel, both along a first direction that extends from the gunbarrel. In some embodiments use a plurality of different-sized of sight indicators along each of a plurality of directions for tracking moving targets approximately in those directions, for helping determine the amount of lead (the angle between the gunbarrel and the line to the target) used when shooting. Some embodiments use indicators, such as printed or embossed lines, icons, or tinted shapes, on a transparent substrate, while others use a wire-like structure formed with the indicators. Some embodiments use an anti-reflective coating.

26 Claims, 12 Drawing Sheets

Fig. 12
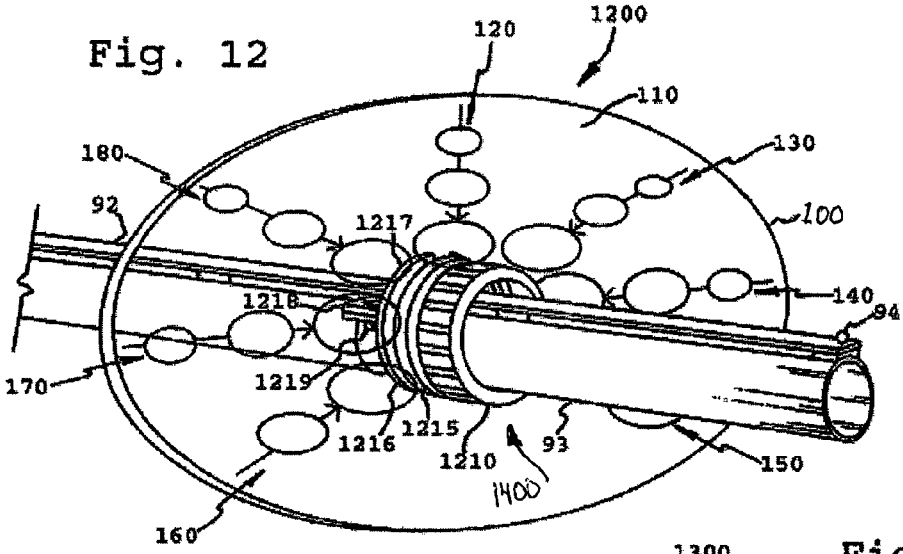
Fig. 13
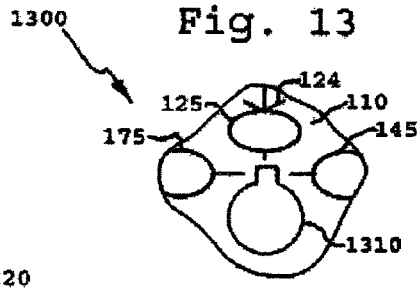
Fig. 14
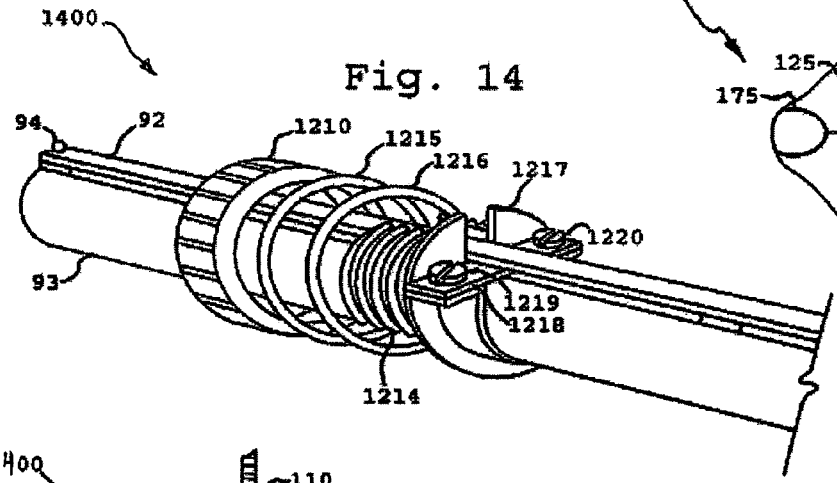
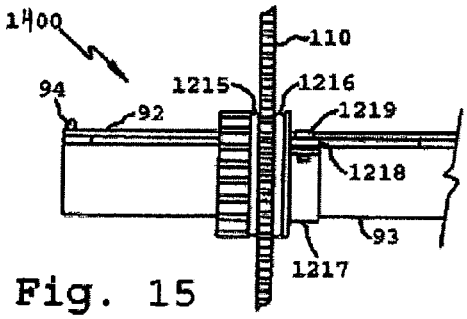
Fig. 15
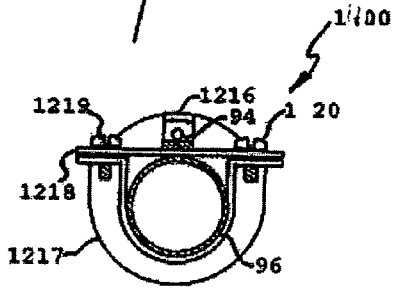
Fig. 16

Fig. 30
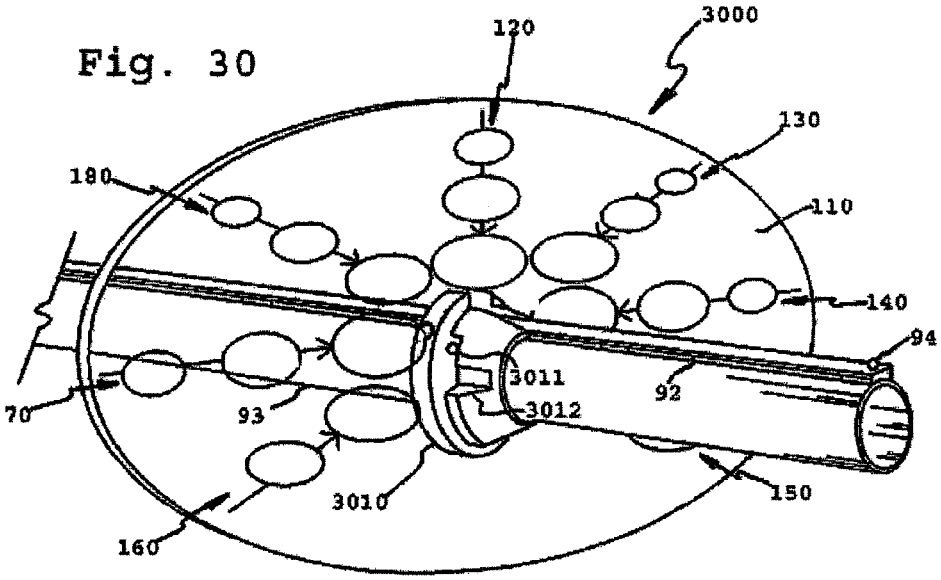
Fig. 31
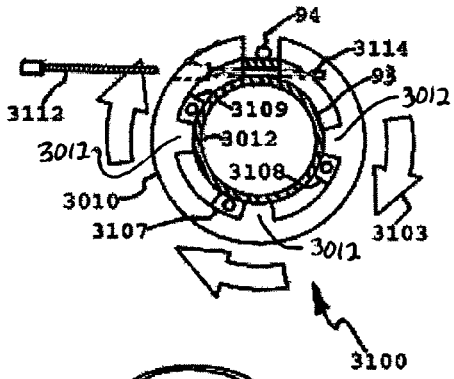
Fig. 33
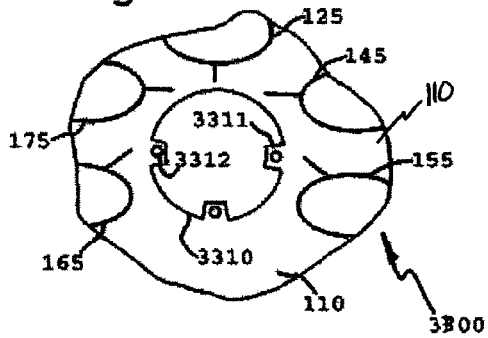
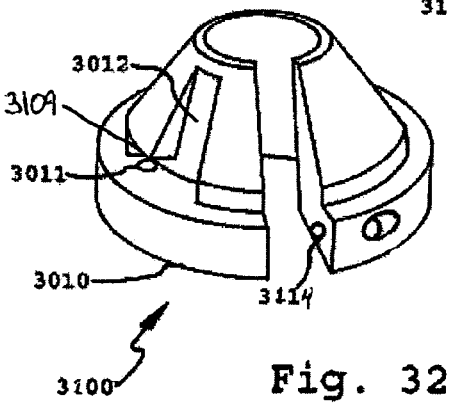
Fig. 32
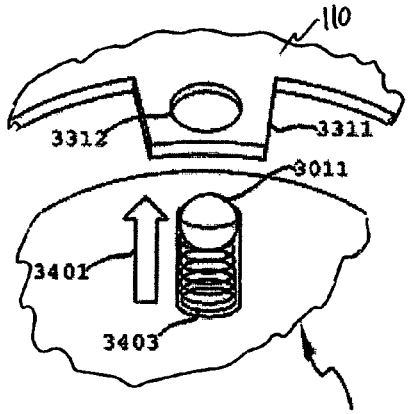
Fig. 34

GUN SIGHT AND METHOD FOR HITTING A MOVING TARGET

FIELD OF THE INVENTION

This invention relates to the field of firearm aiming, and more specifically to a method and apparatus for assisting aiming a gun to appropriately lead a moving target.

BACKGROUND OF THE INVENTION

Firearms have been used by people for centuries. Aiming aids such as sights, crosshairs, or telescopes have been added to various firearms to assist the shooter in pointing the gun at a target.

Since the projectiles shot from a gun have a limited velocity, they drop in a curve (typically an asymmetric parabolic curve). Thus, when shooting at a stationary target, the sight on a gun will be set to aim the barrel (i.e., a straight line extending from the axis of the barrel) above the target by an amount that compensates for the drop in the projectile as it travels the distance to the target.

Moving targets present a more difficult problem. Since the target will have moved some distance left, right, up, or down (and perhaps closer or further away) between the time the projectile is launched and the time the projectile reaches the target, the barrel will have to be pointed to lead the target in its direction of travel. A closer target will require a smaller amount of lead angle than a target further away. A slower target will require a smaller amount of lead than a faster target. With prior-art sights, it has been quite difficult to estimate the size of lead angle to provide.

U.S. Pat. No. 4,112,583, "GUN LEAD SIGHT" issued Sep. 12, 1978 to Castilla describes a lead sight with numbers, corresponding to the numbered shooting positions on a standard skeet range, printed on a transversely extended transparent member mounted by a strap above gun barrels toward the muzzle end. "High" and "Low", also imprinted on the transparent member, correspond to the high house and the low house from which the clay pigeons are released. Such a lead sight purportedly helps the beginner in skeet shooting to lead the skeet clay "bird" properly and helps the experienced shooter having a problem with one or more positions. While perhaps useful for skeet where the target is always at a fixed distance, such a gun sight is much less useful for hunting real game where the target is at various ranges and differing speeds.

U.S. Pat. No. 1,421,553, "GUN SIGHT" issued Jul. 4, 1922 to Pohl describes a lead sight useful for a shotgun, whereby the target object may be sighted while in motion and the shot fired at a lead angle in advance of the target such that the distance traveled by the target during the flight of the shot after discharge of the gun is compensated by the lead angle of the barrel when fired. This sight is formed by a transversely mounted bar having a plurality of bore-hole sight openings formed at different angles (each formed at a different radial angle), the radius center point corresponding to the position of the hunter's eye in sighting along the center ridge. The sight openings are each the same size and shape, other than being at differing angles. The marksman is left with the duty to judge the distance to the object and its speed (e.g., that a bird is flying 350 feet away and at a speed that would need a sight line about eight feet in front of the bird). This would be a difficult judgment task for a hunter in the field hunting real game where the target is at various ranges and differing speeds.

U.S. Pat. No. 3,178,824, "SHOT GUN SIGHTING DEVICE" issued Feb. 16, 1961 to Callihoe describes an elliptical shotgun lead sight with radially extending lines and different sized concentric ellipses. This device also leaves the marksman with the problem of judging distance to the object and its speed.

What is needed is a sight better configured to assist the shooter in estimating the size of lead angle to provide for a given moving target, and to help automatically point the barrel of the gun at the appropriate angle to the target.

SUMMARY OF THE INVENTION

The present invention provides an aiming mechanism and method that provide a plurality of different-sized target alignment indicia extending out in at least one direction from the barrel of a gun, wherein larger-sized artifacts, used to align to closer targets, are placed closer to the barrel of the gun since those closer objects require less leading. By matching the size of the artifact to the apparent size of the moving target, the distance to the target can be compensated for, and the proper amount of lead (the angle for pointing the barrel relative to the target) can be provided for targets of any given distance. By providing different customized sights for targets having different inherent speeds, the appropriate amount of lead can be matched to the speed of the target. Thus, a sight used for hunting pheasants can be customized such that the various different sized artifacts used to estimate distance to the pheasant target can be spaced apart by an amount that also takes into account the average flying speed of a pheasant. Further, a sight used for hunting fast-flying ducks can be customized such that the various different sized artifacts used to estimate distance to the duck target can be spaced apart by an amount that also takes into account the average flying speed of a fast-flying duck.

In some embodiments, the sighting indicia are icons representing the outline of a particular type of game. The icons located closest to the gun barrel are of a large size, which when aligned with a target that is close to the shooter will be of the same size as the apparent size of the target. The icons located furthest from the gun barrel are of a small size, which when aligned with a target that is far to the shooter will be of the same size as the apparent size of that target. The icons located between those located closest to the gun barrel and those located furthest from the barrel are of an intermediate size, which when aligned with a target that is intermediate in distance from the shooter will be of the same size as the apparent size of that target.

Various embodiments provide a method and apparatus configured to be attached to a gunbarrel of a firearm and having a plurality of different-sized sight indicators including a first sight indicator located to be closer to the gunbarrel, and a second sight indicator, smaller than the first sight indicator and located to be further from the gunbarrel, both along a first direction that extends from the gunbarrel. In some embodiments, a series of different-sized sight indicators is provided in each or a plurality of directions for tracking moving targets moving approximately in those directions, for helping the shooter determine the amount of lead (the angle between the gunbarrel and the line to the moving target) to use when shooting such that the moving bullet or pellets intersect with the moving target. Some embodiments use indicators, such as printed or embossed lines, icons, or tinted shapes, supported by a transparent substrate, such that the shooter matches the apparent size of the target with an appropriate sight indicator matching that size and along a line that matches the direction (e.g., of flight) of the target's movement. Other embodiments use a substantially open structure (e.g., formed from wire, thin metal strips, low-aspect-ratio cast plastic rods or strip shapes) with the indicators as shapes of the structure. Some embodiments use an anti-reflective coating. In some embodiments of the invention the sighting indicators or elements are fixed on a frame, while in other embodiments, they are adjustable.

BRIEF DESCRIPTION OF THE DRAWINGS

FIG. 12 is a perspective view of a hunting system 1200 that uses gun sight 100.

FIG. 13 is a an enlarged breakaway view 1300 of the center of gun sight 100.

FIG. 14 is a perspective view of a gun sight clamping system 1400.

FIG. 15 is a side view of a gun sight clamping system 1400.

FIG. 16 is an end view of a gun sight clamping system 1400.

FIG. 30 is a perspective view of a hunting system 3000 that uses a twist-clamping system 3100.

FIG. 31 is an end view of twist-clamping system 3100.

FIG. 32 is a perspective view of twist-clamping system 3100.

FIG. 33 is an enlarged breakaway view 3300 of the center of gun sight 100.

FIG. 34 is an enlarged breakaway perspective view 3300 of the center of gun sight 100.

DESCRIPTION OF PREFERRED EMBODIMENTS

Figure 1:
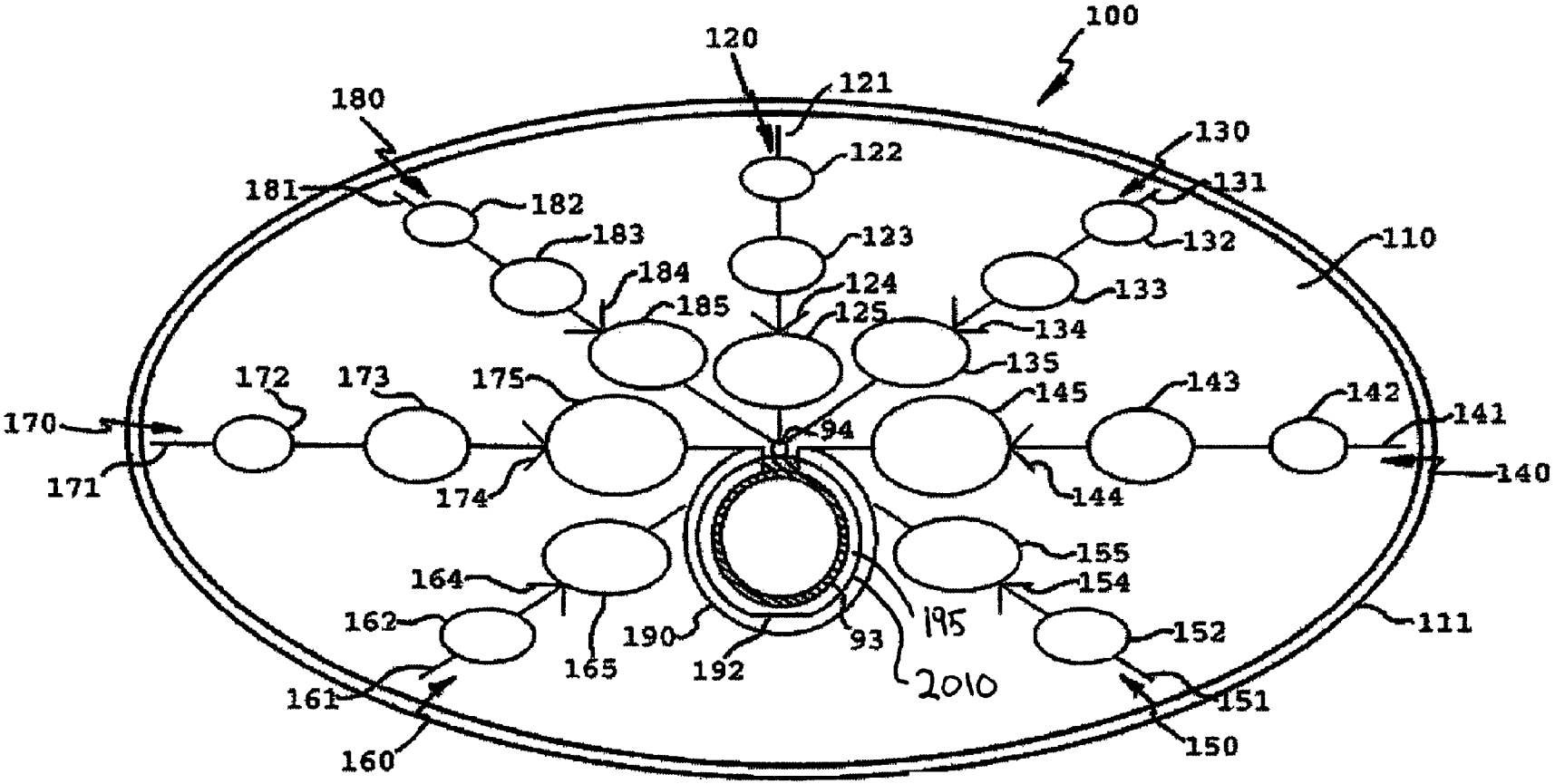
FIG. 1 shows a front view of a gun sight 100 according to one embodiment of the invention.

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

The leading digit(s) of reference numbers appearing in the Figures generally corresponds to the Figure number in which that component is first introduced, such that the same reference number is used throughout to refer to an identical component which appears in multiple Figures. The same reference number or label may refer to signals and connections, and the actual meaning will be clear from its use in the context of the description.

The gun sight of the present invention has been developed to assist shooters in determining the appropriate lead when shooting a moving target. The invention provides a series of sight indicators or sight openings, as will be referred to in the rest of this description, which are, in some embodiments, applied to a transparent material and attached to a gun barrel. The transparent material used allows the shooter to see through the sight indicators to his or her intended target. These sight openings are placed in descending order from largest to smallest starting at the gun barrel and moving outward at multiple angles. There is a direct correlation between the size of the target and the size of the appropriate sight opening selected to make the correct lead necessary to hit the intended target. Closer targets appear larger and require less lead when shooting therefore the larger sight opening is selected. Distant targets appear smaller and require more lead when shooting therefore a smaller sight opening is selected. These sight openings can be made of a many shapes depending on the shooters preference. For example; simple shapes such as circles, ovals or crosshairs can be used with directional indicators for sighting targets. Other shapes such as outline drawings of the intended target can also be used. This gun sight can be used for a variety of shooting sports and be comprised of many shapes and sizes depending on the intended use. Some of these shooting sports include; waterfowl hunting, upland game hunting, sporting clays, trap shooting and skeet. In addition to shooting sports that require a lead for moving targets a gun sight has also been developed for stationary targets as well. This gun sight uses the same concept of descending sight openings. The closer the stationary target is the larger it will appear therefore the larger sight opening is used. Consequently distant targets will appear smaller and a smaller sight opening is used.

Using the Gun Sight:

The fundamental purpose of the gun sight is to help the shooter anticipate the appropriate lead of a moving target while staying focused on the intended target throughout the shot. Shooting moving targets can present many challenges to shooters because of the complex variables involved. When shooting a moving target the shooter must anticipate the appropriate lead needed to hit the target and at the same time keep the gun barrel moving in the same direction as the intended target while maintaining the constant lead determined. The most common mistake shooters make when shooting moving targets is shooting behind the intended target. This can happen for a variety of reasons as follows; the shooter under estimates the correct lead, the shooter stops the gun barrel when firing the shot, the shooter doesn't follow the same line of flight as the intended target, the shooter does what is called flock shooting or the shooter tries to aim at the target. Aiming is one of the most common mistakes of all shooters. Aiming seems to be the most natural thing to do when trying to hit a target. Most shotguns are equipped with a small bead or a more elaborate glowing sight at the end of the barrel. The intended use of these sights is to give the shooter a quick reference point to where the end of the barrel is when shooting. This can be helpful when trying to judge the lead ahead of the moving target. The problem is that most shooters aim down the barrel and try to push the gun ahead of the target using these sights as a guide. This usually results in the shooter chasing the target and never getting out ahead of the intended target. The unique design of this gun sight takes away most of the variables mentioned above and allows the shooter to do what comes natural to them. This gun sight makes it possible for the shooter to aim through the selected sight opening and stay focused on the intended target throughout the shot. Once a sight opening is selected the gun barrel will automatically move ahead of the target at the anticipated lead. In addition the barrel will follow the same flight pattern as the intended target as long as the shooter stays focused on the target and keeps it in the sight opening throughout the shot.

The Lead:

Determining the appropriate lead is often a matter of trial and error. Many variables come into play when trying to judge the right lead for a moving target. Factors that contribute to the process include target speed, direction of target, distance from shooter, wind speed, and ammunition (i.e., which contribute to the inertia and initial speed of the projectile). It can be difficult to correctly anticipate the effects these variables will have each time you shoot. Therefore the shooter must use past experience to help judge the correct lead for a given target.

The present gun sight provides a shooter a quick reference point to start from, and a more consistent success rate once the appropriate lead or sight opening is determined.

The following scenario will help illustrate how a lead is determined. For example, when duck hunting, a common lead is said to be three feet. This is a very difficult concept for most hunters because three feet can mean many things to different shooters, not to mention that it says nothing about the distance to or speed of the target. Three feet is usually used as a good starting point. Often times what happens is that a hunter will hold the gun at what they guess to be three feet ahead of the given target and pull the trigger. The result is usually a miss because no one told them to keep the gun moving ahead of the duck throughout the shot. By using the present gun sight, a hunter can select a sight opening starting with the largest opening closest to the barrel for less lead and work their way out using smaller sight openings for more lead until the correct sight opening (i.e., the sight indicator that matches the apparent size of the target) is determined. Once the correct sight opening is found for a target traveling at a given speed and distance, it is possible for the hunter to quickly aim and shoot, usually resulting in a better success rate.

The shooter must go through the previously mentioned process every time one of these variables changes. For instance, if a duck traveling at the same distance comes from the opposite direction and now is fighting a head wind, this will likely slow down the speed of the duck and less lead may be necessary. Therefore the shooter may have to select a larger opening for less lead in order to hit the intended target.

Overhead Shooting:

When shooting at moving targets overhead or targets coming towards the hunter the most common mistake is trying to shoot as the object approaches. This is a difficult shot because you usually have to cover the target with the gun and guess at the lead. Often times the hunter will only have one shot at this position because the target will be long gone if the hunter tries to turn and shoot again. This usually results in a missed shot and the hunter runs the risk of falling over backwards or even falling in the water, if hunting from a boat. The best way to hit this target is to turn around and wait for it to pass overhead. This way the hunter can keep the intended target in view at all times and better anticipate the lead, plus the hunter can usually get off a second shot in this position if needed. This gun sight has been specially designed to give the hunter the maximum advantage when shooting highflying targets that require an extended lead. The same basic principles come into play when shooting at targets overhead. The hunter simply selects the appropriate sight opening and keeps the target in the opening throughout the shot.

Straight Away Shooting:

Straight away shots are often the most frustrating because the shooter often shoots over the intended target. The target can be hit by holding the gun barrel just over the target at close range, but this requires the shooter to cover the target before shooting. As the target moves away from the shooter it is generally moving in a downward motion. This requires the shooter hold just below the target. In effect the hunter is anticipating the flight pattern of the target and creating a lead. This gun sight allows the shooter to adjust the lead by selecting the correct sight opening. The farther away the target is from the shooter the smaller the sight opening and the greater the lead.

FIG. 1 shows a front view of a gun sight 100 according to one embodiment of the invention. In some embodiments, gun sight 100 is made of a clear substrate 110, such as a plastic such as Lexan®, or hardened glass, or other suitable substantially clear, strong, resilient material. Substrate 110 can be (in various embodiments) water-clear, or tinted some color or shade of grey. Substrate 110 has a pattern of sight indicators that are (in various embodiments) printed, painted, stained, engraved, embossed, burned, formed by a focused laser, or otherwise formed on or in substrate 110. These sight indicators can be opaque, or translucent or transparent, and/or tinted a different color or shade of grey. The sized sight indicators (such as 142, 143, or 145) can be indicated as outlines (as the lines shown in FIG. 1), or as solid shapes (such as a tinted oval filled with a solid or varying color). Thus, the lines shown can be ink, paint, stain, color, etched metal lines, indentations, grooves, bubbles, opacities, shading, tinting, differences in index of refraction, or other visible means formed within and/or on the surface of substrate 110. The term "indicia on substrate 110" as used herein thus shall include any such indicators or indicia on the surface and/or within the substrate between the front and back surfaces.

Each group of sight indicators (for example, group 140, which includes sight indicators 142, 143, and 145, and optional line 141 and arrowhead 144) is intended for targets moving in a certain direction. In the case of group 140, this is a right-to-left direction. In the embodiment of gun sight 100, each sight indicator is a generic geometric shape, such as an oval, which can be used for a wide variety of targets such as clay targets, ducks, or pheasants. For far-away targets, the apparent size of the target will be relatively small, and the smallest sight indicator (i.e., oval 142) will most closely match the apparent size of the target as viewed through the gun sight 100. When the user aligns sight indicator 142 with the target (whose apparent size, when viewed through gun sight 100, most closely matches the size of sight indicator 142) that is moving right-to-left, the gunbarrel 93 will be pointed in a left-pointing direction that leads the target by a substantial amount, thus allowing the projectile and the target more time to reach the point of impact. If the target is much closer to the user, it will appear much larger, and will have an apparent size, when viewed through gun sight 100, that most closely matches the size of sight indicator 144. When the user aligns sight indicator 144 with this closer target that is moving right-to-left, the gunbarrel 93 will be pointed in a left-pointing direction that leads the target by a small amount, thus allowing the projectile and the target less time to reach the point of impact. Sight indicator 143 is used for targets at an intermediate range.

The other groups if sight indicators are used for targets moving in other directions. Each group will typically have one or more sight (usually two or three) sight indicators, and optionally a line and arrowhead. Group 120, consisting of sight indicators 122, 123, and 125, line 121, and arrowhead 124, would typically be used for overhead targets flying straight away from the shooter.

Group 130, consisting of sight indicators 132, 133, and 135, line 131, and arrowhead 134, would typically be used for overhead targets flying away and right-to-left from the shooter. Group 150, consisting of sight indicators 152 and 155, line 151, and arrowhead 154, would typically be used for just-flushed targets flying upwards and right-to-left from the shooter.

Group 180, consisting of sight indicators 182, 183, and 185, line 181, and arrowhead 184, would typically be used for overhead targets flying away and left-to-right from the shooter. Group 160, consisting of sight indicators 152 and 165, line 161, and arrowhead 164, would typically be used for just-flushed targets flying upwards and left-to-right from the shooter.

Finally, group 170, consisting of sight indicators 172, 173, and 175, line 171, and arrowhead 174, would typically be used for overhead targets flying left-to-right relative to the shooter.

In other embodiments, other numbers of groups of sight indicators are provided. In some embodiments, an anti-reflective coating is applied to the front or back of substrate 110, or both. In some embodiments, gun sight 100 is removably affixed to the distal end of gunbarrel 93 near the front bead 94 using a locking ring 192 that is attached to gunbarrel 93, and a matching clamping ring 190. In some embodiments, substrate 110 has a hole 2010 with a bottom flat, and is clamped between locking ring 195 (with its corresponding bottom flat 192) and matching clamping ring 190. In other embodiments, hole 2010 in substrate 110 has other shapes, such as a plain circle, or an over/under overlapping pair of circles to match an over/under double-barreled shotgun, or a side-by-side overlapping pair of circles to match an side-by-side double-barreled shotgun.

Figures 2, 3:
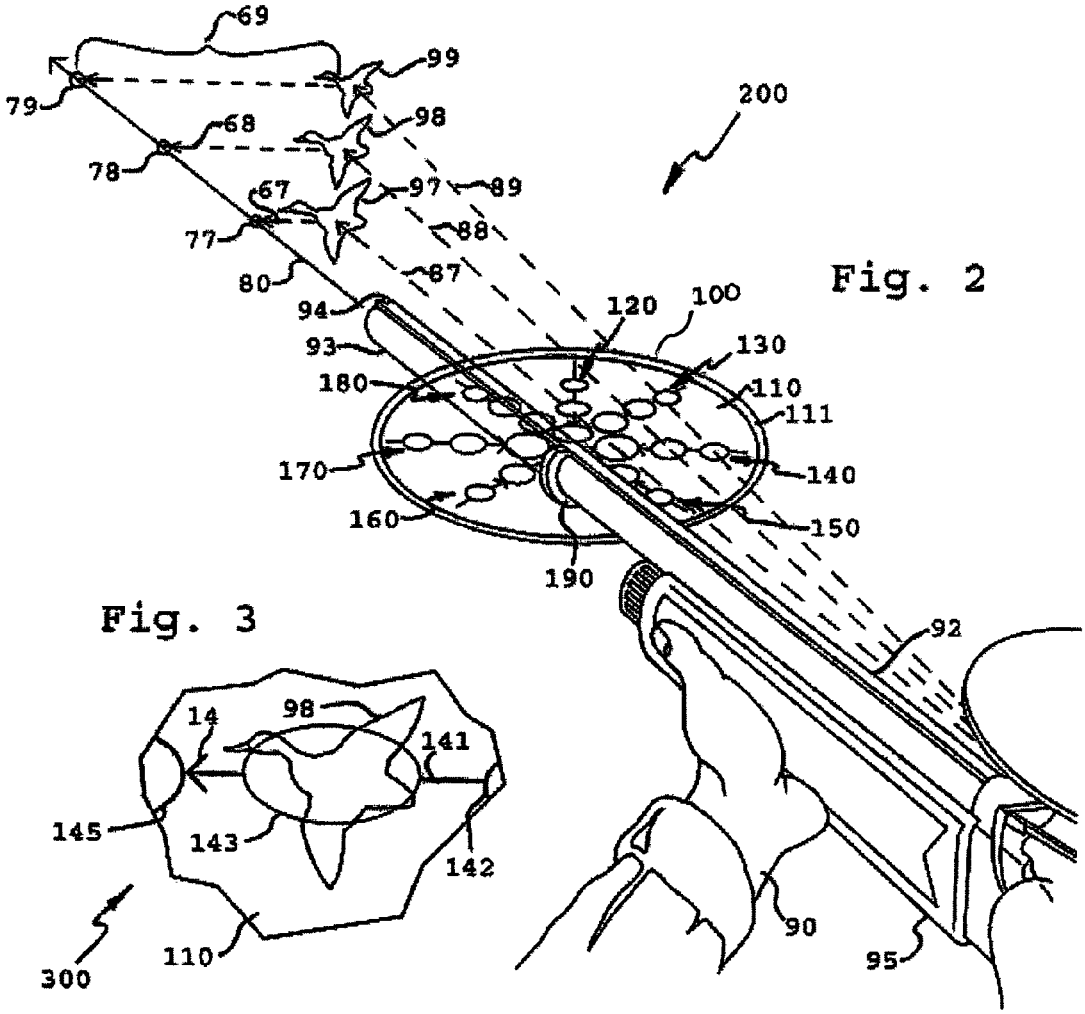
FIG. 2 is a perspective view of a hunting system 200 that uses gun sight 100.
FIG. 3 is an enlarged breakaway view 300 of a duck 98 sighted through gun sight 100.

FIG. 2 shows a hunting system 200 with a hunter 90 holding a firearm 95 (such as a shotgun). Three possible targets, 97, 98, and 99, are shown at different distances. Firearm 95 can be a conventional shotgun having a sighting rib 92 and/or a sighting bead 94 formed or attached to gun barrel 93. In some embodiments, the surface plane of gun sight 100 (such as described for FIG. 1 above) is attached to be substantially perpendicular to the longitudinal axis of barrel 93. In other embodiments, the plane of gun sight 100 is tilted relative to the longitudinal axis of barrel 93, for example, having the top edge further from the butt end of the gun than the bottom edge (or, as shown in FIG. 2, having the left edge further away than the right edge), for example in order to reduce outward reflections that might spook the game that is being hunted, and/or reflections back to the shooter that interfere with the view of the game.

To illustrate the operation and use of the gun sight 100 as shown in FIG. 2, suppose a target, such as a flying duck, is moving in a substantially horizontal direction from right to left as viewed by the shooter 90. The shooter will choose to use sight indicator group 140, which includes (as shown in FIG. 1) sight indicators 142, 143, and 145, and optional line 141 and arrowhead 144, which is intended for targets moving in the right-to-left direction (as indicated by the direction of arrowhead 144). If the target is relatively far away, such as at position 99, the axis 80 of the barrel 93 should be pointed at a relatively large angle in front of the target 99. Since the target 99 will have a relatively small size due to its distance along line 89 from the shooter, the shooter will use the relatively small sight indicator 142 furthest from the barrel, and obtaining the large lead angle between line 89 and the line of the barrel axis 80. The target 99 initially at the position shown when the shot is taken will traverse distance 69, and the bullet or pellet projectile(s) will then intersect the target at point 79.

If the target is relatively close, such as at position 97, the axis 80 of the barrel 93 should be pointed at a relatively small angle in front of the target. Since the target 97 will have a relatively large apparent size due to its close distance along line 87 from the shooter, the shooter will use the relatively large sight indicator 145 closest to the barrel, and obtaining the small lead angle between line 87 and the line of the barrel axis 80. The target 97 initially at the position shown when the shot is taken will traverse distance 67, and the bullet or pellet projectile(s) will then intersect the target at point 77.

If the target is at an intermediate distance, such as at position 98, the axis 80 of the barrel 93 should be pointed at a intermediate angle in front of the target. Since the target 98 will have an intermediate apparent size due to its intermediate distance along line 88 from the shooter, the shooter will use the middle-sized sight indicator 143, and obtaining the intermediate lead angle between line 88 and the line of the barrel axis 80. The target 98 initially at the position shown when the shot is taken will traverse distance 68, and the bullet or pellet projectile(s) will then intersect the target at point 78.

FIG. 3 shows a view 300 as seen by the shooter with the sight indicator 143 superimposed over the target 98, as viewed through transparent substrate 110. The target 98

(e.g., a duck flying right to left) is moving in the direction of arrowhead 144, and thus the shooter selects indicator group 140 to use for aiming. If the target is moving in another direction, then one of the other groups 120, 130, 150, 160, 170, or 180 is selected, as appropriate.

Figure 4:
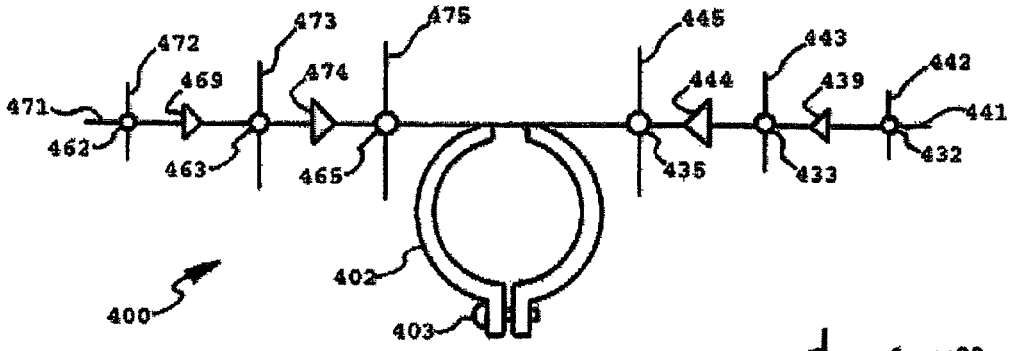
FIG. 4 is a front view of a gun sight 400.

FIG. 4 shows a front view of a gun sight 400. Rather than being visible indicia on a transparent substrate such as gunsight 100 of FIG. 1, gun sight 400 is formed from a thin solid material, such as one or more strips of metal (e.g., spring steel) formed or welded into the desired shape. In the embodiment shown, a flat horizontal strip 441 (i.e., a strip that is thin as viewed, but wider in a direction perpendicular to the sheet of the drawing) has a series of beads 432, 433, 435, a series of different-sized cross-wise strips 442, 443, and 445, and/or one or more arrowheads 439 and 444 affixed to its right side and used for targets moving right-to-left. Further, flat horizontal strip 441 has a series of beads 462, 463, and/or 465, a series of different-sized cross-wise strips 472, 473, and 475, and/or one or more arrowheads 469 and 474 affixed to its left side and used for targets moving left-to-right. In some embodiments, a clamp 402 and fastening mechanism 403 (such as a machine screw or bolt, and a nut or threaded lip) are provided to attach gun sight 400 to a gun barrel.

In other embodiments, the crossbars 442, 443, 445, 472, 473, and 475 are omitted, and the spacing between beads 462 and 463 is made smaller than the spacing between beads 463 and 465. Similarly, the spacing between beads 432 and 433 is made smaller than the spacing between beads 433 and 435. In some such embodiments, the arrowheads 444, 439, 474, and/or 469 are also omitted. In these embodiments, the spacings between beads are used as the size indicators used to align with the relative apparent size of the target 98 (or 97 or 99) of FIG. 7 to select the proper lead angle.

Figure 5:
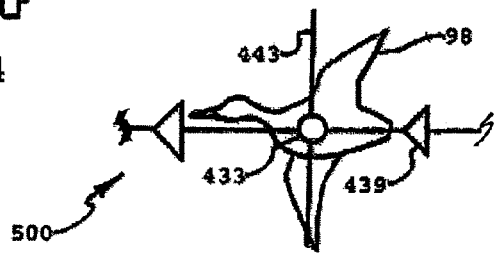
FIG. 5 is an enlarged breakaway view 500 of a duck 98 sighted through gun sight 400.

FIG. 5 is an enlarged breakaway view 500 of a duck 98 sighted through a portion of gun sight 400, wherein crossbar 443 is selected as the appropriately-sized sight indicator, since it approximately matches the apparent size of target 98.

Figure 6:
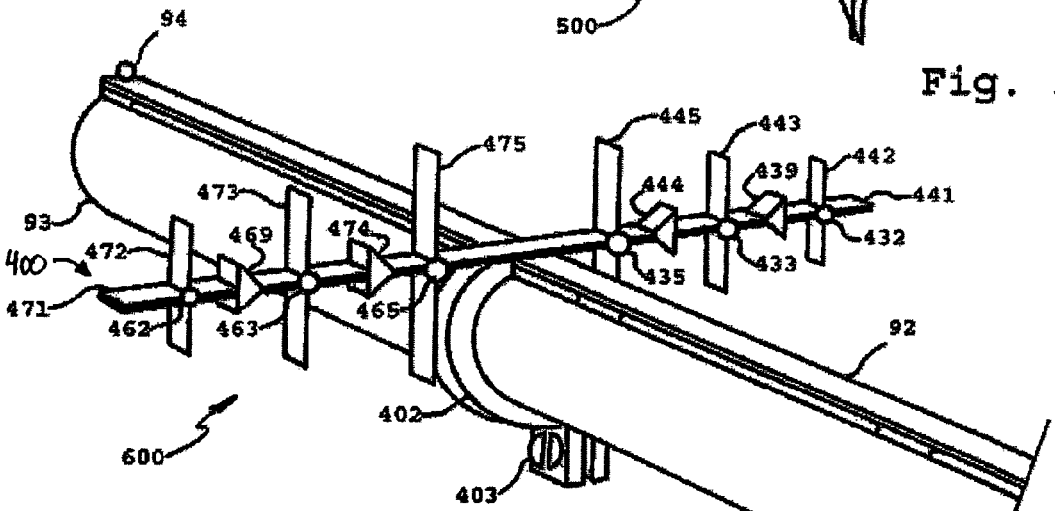
FIG. 6 is a perspective view of a hunting system 600 that uses gun sight 400.

FIG. 6 is a perspective view of a hunting system 600 that uses gun sight 400 attached to the gun barrel 93 of a firearm. Clamp 402 is shaped to accommodate the size and shape of gunbarrel 93 and sighting rib 92. In some embodiments, clamp 402 is flexible enough to allow sliding of the gun sight 400 over front sighting bead 94 of the gun. In the embodiment shown, gunsight 400 has a longitudinal cross section that is relatively long in the direction parallel to the axis of the gun barrel 93 to provide extra strength, but narrow as viewed by the shooter to reduce the amount of sight blocked by gunsight 400. In some embodiments, gunsight 400 is made of one or more folded and/or welded strips of metal, such as spring steel. In other embodiments, gun sight 400 is cast from metal and/or plastic material(s). In some embodiments, arrowheads 439, 444, 474, and 469 are solid, while in other embodiments, they are hollow in order to block less of the view.

Figure 7:
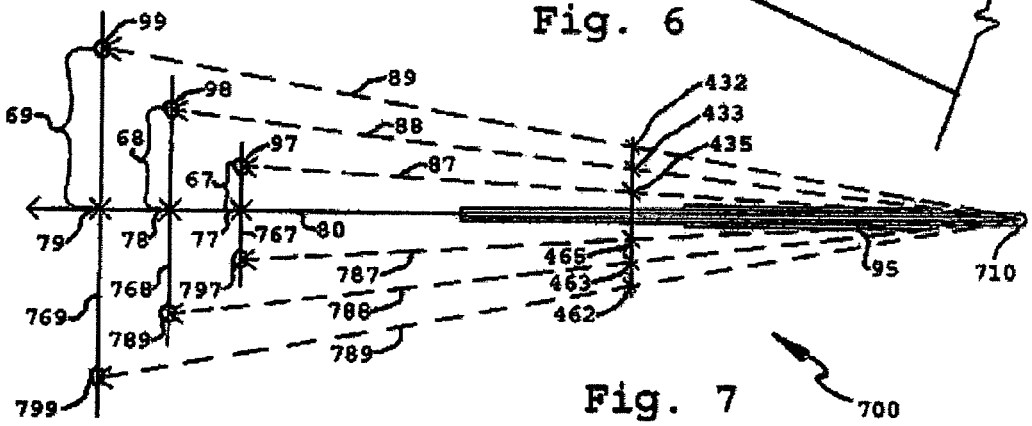
FIG. 7 is a top view schematic 700 of the use of gun sight 400.

FIG. 7 is a top view schematic 700 of the use of gun sight 400. The shooter's eye is at location 710 looking approximately along the barrel of gun 95. A distant target 99 moving right-to-left (downward in the figure) would be tracked and aligned to sight indicator 442 and/or bead 432 along line 89 and the trigger pulled. The target would travel distance 69 during the flight time of the projectile(s) and would be hit at location 79. A close target 97 moving right-to-left (downward in the figure) would be tracked and aligned to sight indicator 445 and/or bead 435 along line 87 and the trigger pulled. The target would travel distance 67 during the flight time of the projectile(s) and would be hit at location 77. An intermediate-distance target 98 moving right-to-left (downward in the figure) would be tracked and aligned to sight indicator 443 and/or bead 433 along line 88 and the trigger pulled. The target would travel distance 68 during the flight time of the projectile(s) and would be hit at location 78.

A distant target 799 moving left-to-right (upward in the figure) would be tracked and aligned to sight indicator 472 and bead 462 along line 89 and the trigger pulled. The target would travel distance 769 during the flight time of the projectile(s) and would be hit at location 79. A close target 797 moving left-to-right (upward in the figure) would be tracked and aligned to sight indicator 475 along line 787 and the trigger pulled. The target would travel distance 767 during the flight time of the projectile(s) and would be hit at location 77. An intermediate-distance target 798 moving left-to-right (upward in the figure) would be tracked and aligned to sight indicator 473 along line 788 and the trigger pulled. The target would travel distance 768 during the flight time of the projectile(s) and would be hit at location 78.

Figure 8:
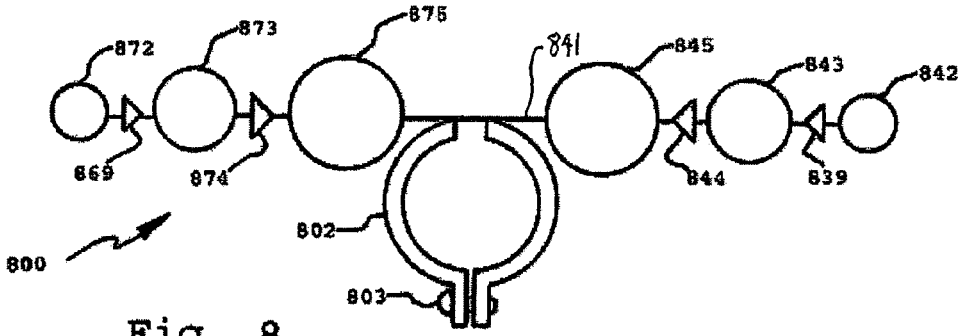
FIG. 8 is a front view of a gun sight 800, an alternative embodiment.

FIG. 8 is a front view of a gun sight 800, an alternative embodiment of the gunsight of FIG. 4, is again formed from a thin solid material, such as one or more strips of metal (e.g., spring steel) formed or welded into the desired shape. Rather than being vertical lines indicia (such as 442, 443, and 445 as crossbars on horizontal support 441, such as gunsight 400 of FIG. 4, gun sight 800 uses thin geometric shapes such as the circles shown in FIG. 8. In other embodiments, the geometric shape is chosen as a square, diamond, oval, duck outline, or other shape.

In the embodiment shown, a flat horizontal strip 841 (i.e., a strip that is thin as viewed, but wider in a direction perpendicular to the sheet of the drawing) has a series of different-sized geometric shapes 842, 843, and 845, and/or one or more arrowheads 839 and 844 affixed to its right side and used for targets moving right-to-left. Further, flat horizontal strip 841 has a series of different-sized geometric shapes 872, 873, and 875, and/or one or more arrowheads 869 and 874 affixed to its left side and used for targets moving left-to-right. In some embodiments, a clamp 802 and fastening mechanism 803 (such as a machine screw or bolt, and a nut or threaded lip) are provided to attach gun sight 800 to a gun barrel.

In other embodiments, more or fewer than 3 sight indicators are provided along each motion path (here, a right-to-left motion path and a left-to-right motion path. In other embodiments, the invention provides more motion paths (such as the seven motion paths of FIG. 1) or fewer motion paths (such as a single motion path vertically above the gun barrel for targets flying away from the shooter) and corresponding groups of sight indicators.

Figure 9:
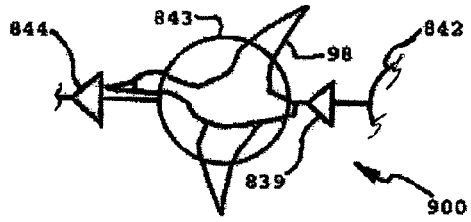
FIG. 9 is an enlarged breakaway view 900 of a duck 98 sighted through gun sight 900.

FIG. 9 is an enlarged breakaway view 900 of a duck 98 sighted through gun sight 900, wherein circle 843 is selected as the appropriately-sized sight indicator, since it approximately matches the apparent size of target 98.

Figure 10:
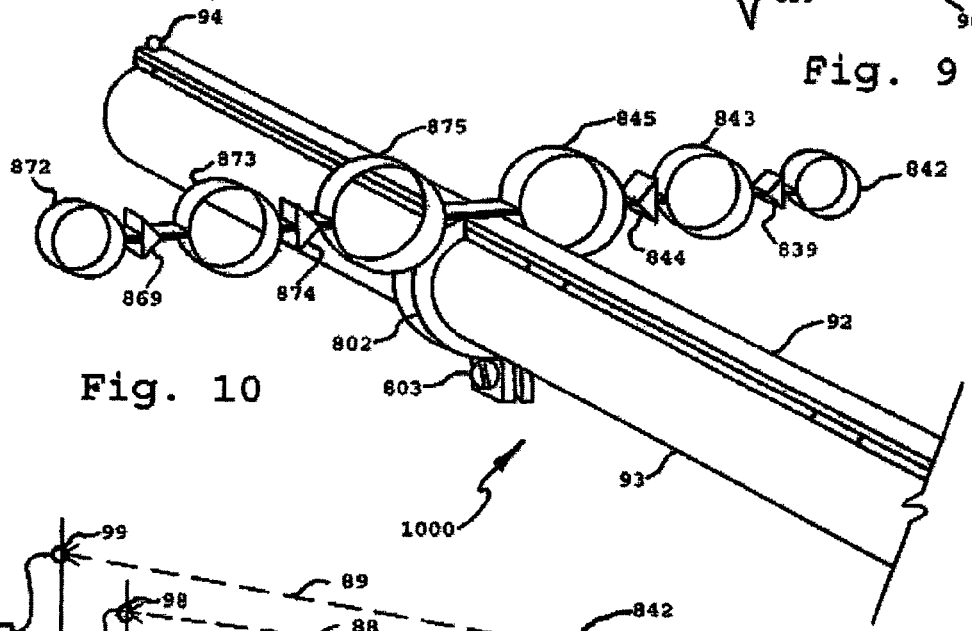
FIG. 10 is a perspective view of a hunting system 1000 that uses gun sight 800.

FIG. 10 is a perspective view of a hunting system 1000 that uses gun sight 800 attached to the gun barrel 93 of a firearm. Clamp 802 is shaped to accommodate the size and shape of gunbarrel 93 and sighting rib 92. In some embodiments, clamp 802 is flexible enough to allow sliding of the gun sight 800 over front sighting bead 94 of the gun. In the embodiment shown, gunsight 800 has a longitudinal cross section that is relatively long in the direction parallel to the axis of the gun barrel 93 to provide extra strength, but narrow as viewed by the shooter to reduce the amount of sight blocked by gunsight 800. In some embodiments, gunsight 800 is made in a manner such as described for gunsight 400 above.

Figure 11:
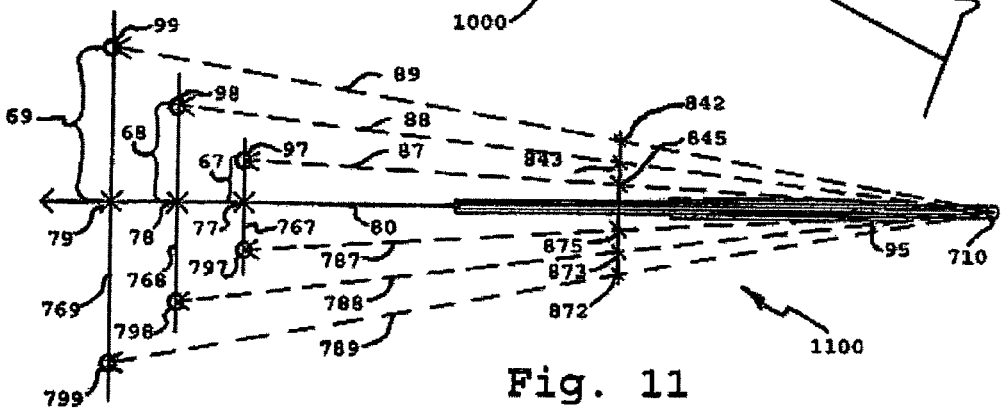
FIG. 11 is a top view schematic 1100 of the use of gun sight 800.

FIG. 11 is a top view schematic 1100 of the use of gun sight 800. The shooter's eye is at location 710 looking approximately along the barrel of gun 95. A distant target 99 moving right-to-left (downward in the figure) would be tracked and aligned to sight indicator 842 along line 89 and the trigger pulled. The target would travel distance 69 during the flight time of the projectile(s) and would be hit at location 79. A close target 97 moving right-to-left (downward in the figure) would be tracked and aligned to sight indicator 845 along line 87 and the trigger pulled. The target would travel distance 67 during the flight time of the projectile(s) and would be hit at location 77. An intermediate-distance target 98 moving right-to-left (downward in the figure) would be tracked and aligned to sight indicator 843 along line 88 and the trigger pulled. The target would travel distance 68 during the flight time of the projectile(s) and would be hit at location 78.

A distant target 799 moving left-to-right (upward in the figure) would be tracked and aligned to sight indicator 872 along line 89 and the trigger pulled. The target would travel distance 769 during the flight time of the projectile(s) and would be hit at location 79. A close target 797 moving left-to-right (upward in the figure) would be tracked and aligned to sight indicator 875 along line 787 and the trigger pulled. The target would travel distance 767 during the flight time of the projectile(s) and would be hit at location 77. An intermediate-distance target 798 moving left-to-right (upward in the figure) would be tracked and aligned to sight indicator 873 along line 788 and the trigger pulled. The target would travel distance 768 during the flight time of the projectile(s) and would be hit at location 78.

FIG. 12 is a perspective view of a hunting system 1200 that uses gun sight 100 held to gun barrel 93 by clamping system 1400. Clamping system 1400 makes it easy and quick to change gun sights for different target types. In some embodiments, clamping system 1400 includes a fixed portion 1217 that is held to gun barrel 93 by bars 1218 and screws 1219 and 1220). A removable clamp portion 1210 engages with the fixed portion 1217, for example using mating threads. Some embodiments include a rear rubber O-ring 1216 and front O-ring 1215 that are squeezed against substrate 110, helping to prevent cracking of the plastic and rotation of the substrate 110 relative to the gun barrel (particularly if no key is provided in opening 1310.

FIG. 13 is a an enlarged breakaway view 1300 of the center of gun sight 100. In some embodiments, a keyed opening 1310 is provided, having a notch to fit over rib 92 of the gun, helping assure that it stays in the correct orientation to the gun.

FIG. 14 is an exploded perspective view of gun sight clamping system 1400. FIG. 15 is a side view of gun sight clamping system 1400. FIG. 16 is an end view of gun sight clamping system 1400. The fixed portion is 1217 held to gun barrel 93 using bars 1218 and screws 1219 and 1220. rear O-ring 1216 is then mounted, the substrate 110 slid in place, the front O-ring added, and the removable clamp portion 1210 is screwed onto fixed portion 1217.

Figure 17:
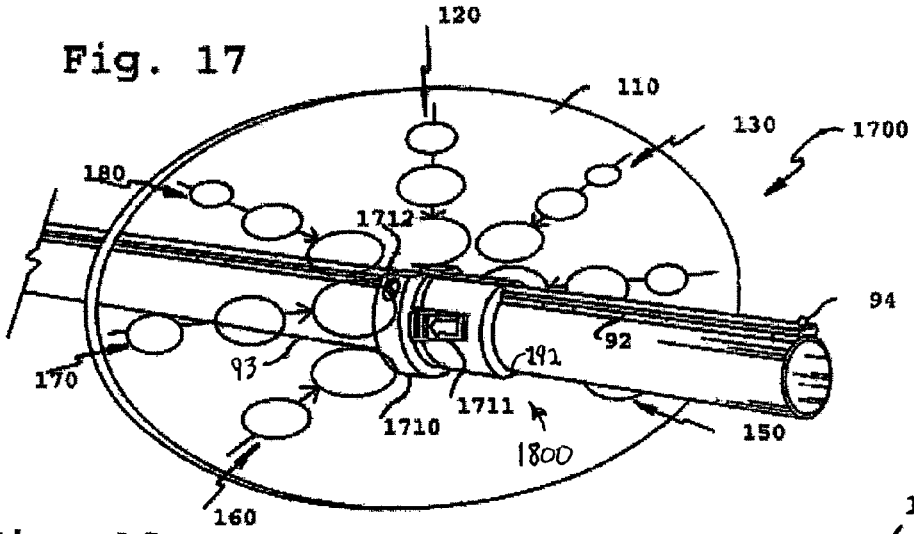
FIG. 17 is a perspective view of a hunting system 1700 that uses gun sight 100.

FIG. 17 is a perspective view of a hunting system 1700 that uses gun sight 100 held in place by snap clamping system 1800. Clamp body 1710, which has one or more spring-loaded wings 1711, is held in place on gun barrel 93 by hex screw 1712.

Figure 18:
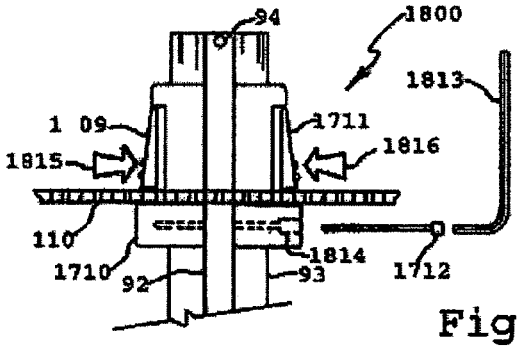
FIG. 18 is a top view of a snap-clamping system 1800.

FIG. 18 is a top view of a snap-clamping system 1800. In some embodiments, clamp body 1710, is held in place on gun barrel 93 by hex screw 1712 that is threaded into threaded aperture 1814 using hex key 1813. Spring-loaded wing 1709 is located opposite spring-loaded wing 1711, and inward forces 1815 and 1816 deflect these wings inward so gunsight 100 can be snapped in place.

Figure 19:
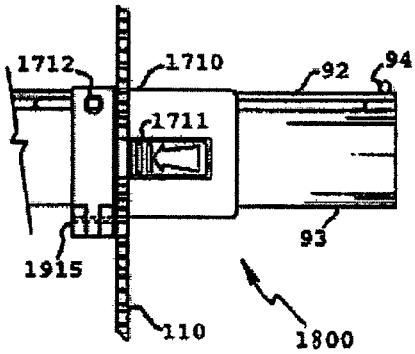
FIG. 19 is a side view of a snap clamping system 1800.

FIG. 19 is a side view of a snap clamping system 1800. In some embodiments, body 1710 includes a hinge 1915 that allows the body 1710 to swing open so it can easily be placed onto gun barrel 93.

Figure 20:
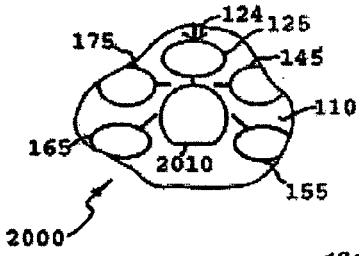
FIG. 20 is a an enlarged breakaway view 2000 of the center of gun sight 100.

FIG. 20 is a an enlarged breakaway view 2000 of the center of gun sight 100, having an opening 2010 that has a flat at its bottom to match flat 192 of the snap clamping system 1800.

Figure 21:
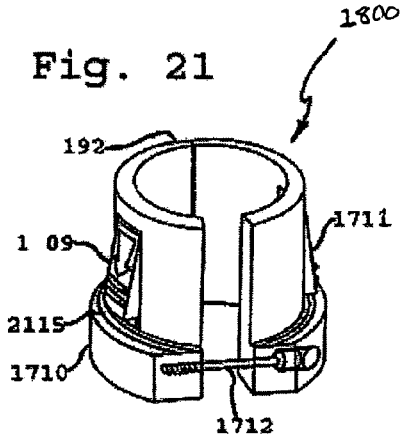
FIG. 21 is a top perspective view of snap clamping system 1800.

FIG. 21 is a top perspective view of snap clamping system 1800. In some embodiments, a elastic (e.g., rubber) gasket 2115 is affixed in a groove around body 1710, to provide cushioning and a friction fit to hold gunsight 100 in place. In some embodiments, a flat (or other keying feature) 192 is provided on one or more sides to help align and hold gunsight 100 in place.

Figure 22:
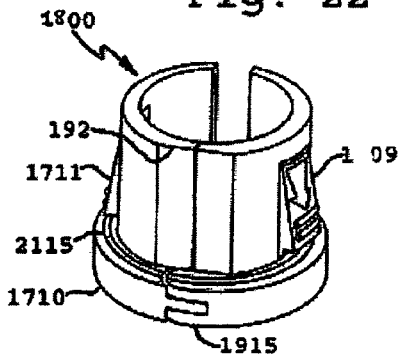
FIG. 22 is a bottom perspective view of a snap clamping system 1800.

FIG. 22 is a bottom perspective view of a snap clamping system 1800, more clearly showing bottom flat 192 and hinge 1915.

Figure 23:
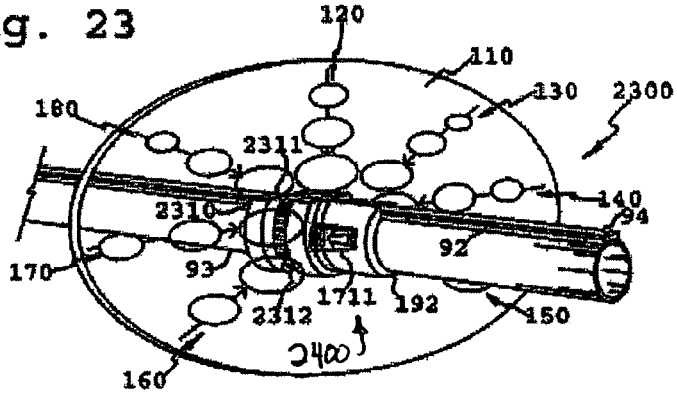
FIG. 23 is a perspective view of a hunting system 2300 that uses a snap-clamping system 2400.

FIG. 23 is a perspective view of a hunting system 2300 that uses gun sight 100 held in place by snap clamping system 2400. Clamp body 2310, which has one or more spring-loaded wings 1711, is held in place on gun barrel 93 by hose clamp 2311 and its screw 2312. The other aspects are as described above.

Figure 24:
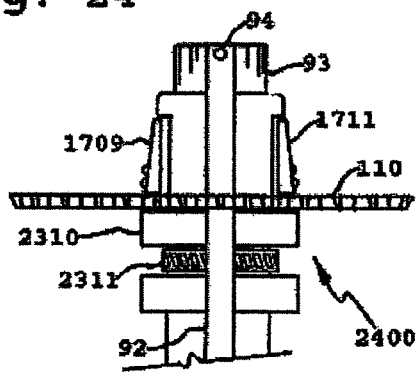
FIG. 24 is a top view of snap-clamping system 2400.

FIG. 24 is a top view of snap-clamping system 2400 holding substrate 110 with spring-loaded wing 1709 and opposite spring-loaded wing 1711.

Figure 25:
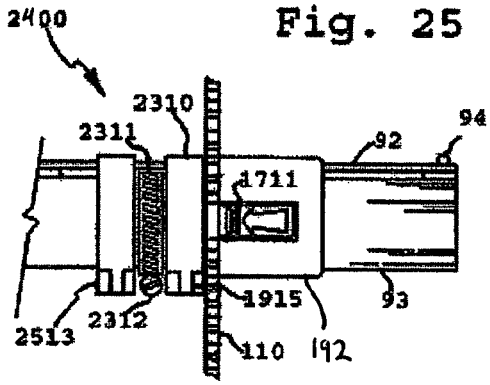
FIG. 25 is a side view of snap clamping system 2400.

FIG. 25 is a side view of snap-clamping system 2400, showing rear hinge 2513 and front hinge 1915.

Figure 26:
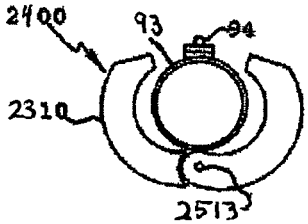
FIG. 26 is a back-end view of snap clamping system 2400.

FIG. 26 is a back-end view of snap-clamping system 2400, showing clamp body 2310 swung open usingrear hinge 2513.

Figure 27:
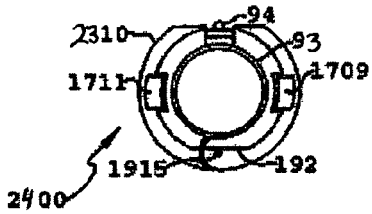
FIG. 27 is a front-end view of snap clamping system 2400.

FIG. 27 is a front-end view of snap-clamping system 2400, showing front hinge 1915 and flat 192, and spring-loaded wing 1709 and opposite spring-loaded wing 1711.

Figure 28:
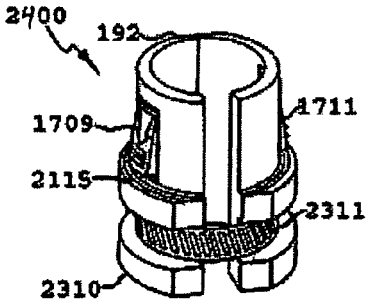
FIG. 28 is a top perspective view of snap clamping system 2400.

FIG. 28 is a top perspective view of snap-clamping system 2400.

Figure 29:
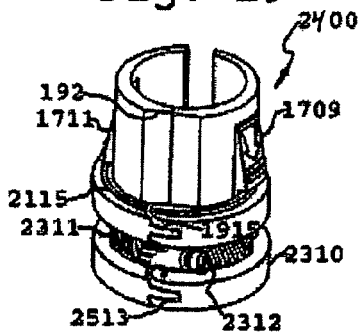
FIG. 29 is a bottom perspective view of snap clamping system 2400.

FIG. 29 is a bottom perspective view of snap clamping system 2400.

FIG. 30 is a perspective view of a hunting system 3000 that uses a twist-clamping system 3100. In some embodiments, one or more notches 3012 are provided in body 3010, and one or more spring-loaded balls 3011 hold substrate 110 once it is twisted into place.

FIG. 31 is an end view of twist-clamping system 3100. Screw 3112 goes into threaded opening 3114 to hold body 3010 onto gun barrel 93. Substrate 110 is slid into place with its tabs in notches 3012, and then twisted in direction 3103, such that the tabs 3311 go into slits 3107, 3108, and 3109.

FIG. 32 is a perspective view of twist-clamping system 3100. Substrate 110 is slid into place with its tabs 3311 in notches 3012, and then twisted such that one of the tabs 3311 goes into slits 3109 and is held by spring-loaded ball 3011.

FIG. 33 is a an enlarged breakaway plan view 3300 of the center of gun sight 100, which in the embodiment shown, has three tabs 3311 into opening 3310, each having an indentation or hole 3312 to accommodate a spring-loaded ball 3011.

FIG. 34 is a an enlarged breakaway perspective 3300 of the center of gun sight 100. In some embodiments, spring 3401 provides a force 3401 to spring-loaded ball 3011, urging it into hole 3312 of tab 3311 of substrate 110, when it is twisted into place.

Figure 35:
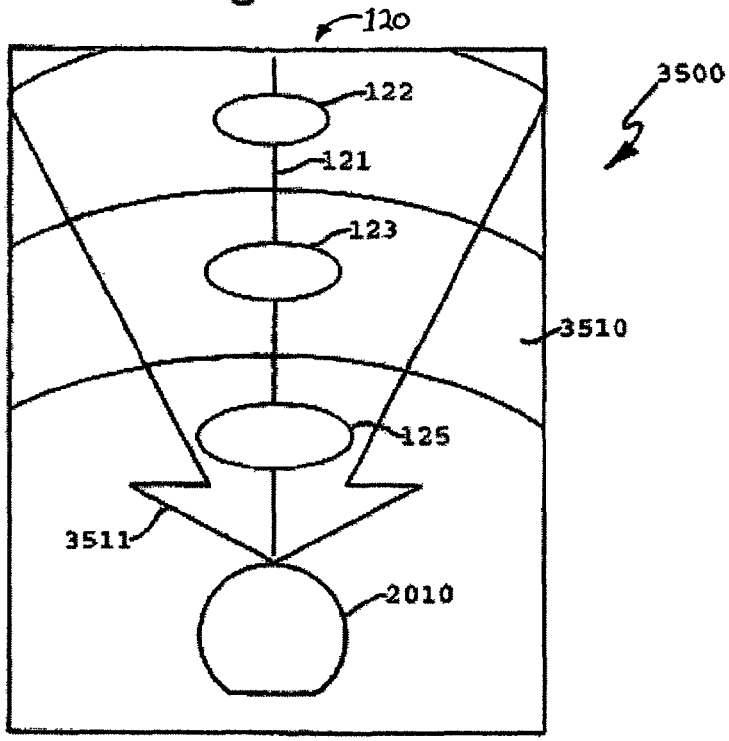
FIG. 35 is front view of a gun sight design 3500.

FIG. 35 is front view of a rectangular gun sight design 3500. Substrate 3510 has an opening 2010 that has a flat at its bottom to match flat 192 of the snap clamping system 1800. A single group of sight indicators 120, in some embodiments, includes a plurality of different sized of sight indicators including a first sight indicator 125 configured to be closer to the gunbarrel, and a second sight indicator 122, smaller than the first sight indicator and configured to be further from the gunbarrel (that fits through hole 2010), both sight indicators along a first direction (as indicated, in some embodiments, by line 121) that extends from the gunbarrel. In some embodiments, the outer edge of gun sight 3500 has other shapes, such as an oval, diamond, or hexagon, for example. In some embodiments, the plurality of sight indicators 120 further includes a third sight indicator 123 configured to be between the first sight indicator 125 and the second sight indicator 122 along the first direction, and having a size between the size of the first sight indicator 125 and the size of the second sight indicator 122.

Figure 36:
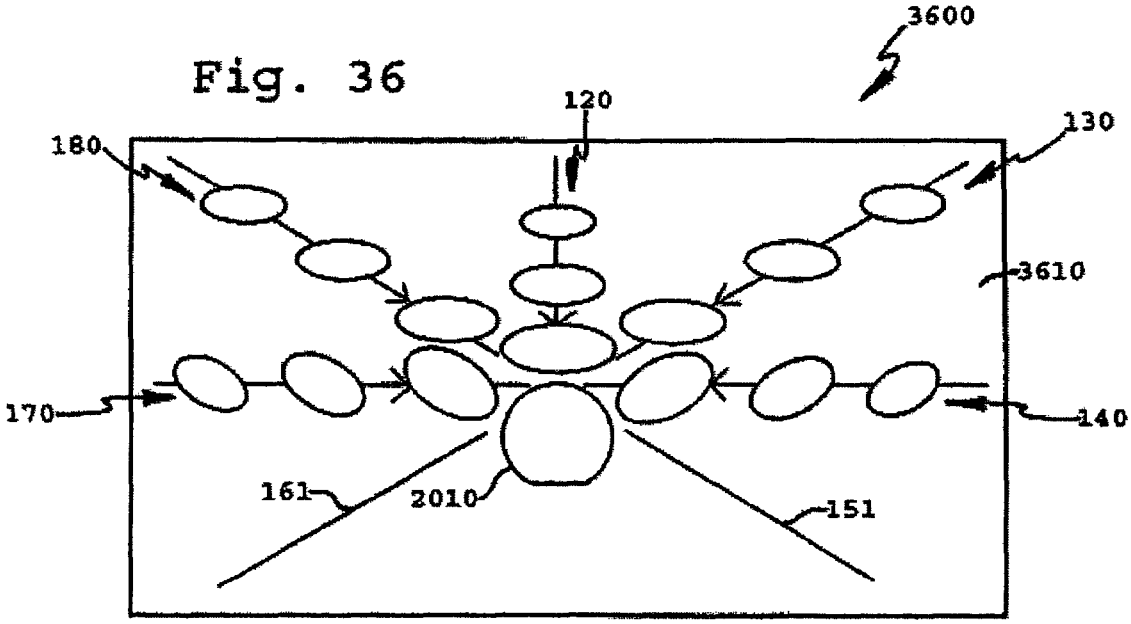
FIG. 36 is front view of a gun sight design 3600.

FIG. 36 is front view of a gun sight design 3600. Substrate 3610 has an opening 2010 that has a flat at its bottom to match flat 192 of the snap clamping system 1800. A plurality of groups of sight indicators 120, 130, 140, 170, and 180 are provided in the embodiment shown. In some embodiments, sight lines 151 and 161 are provided. In other embodiments, different numbers of groups of sight indicators are provided.

Figure 37:
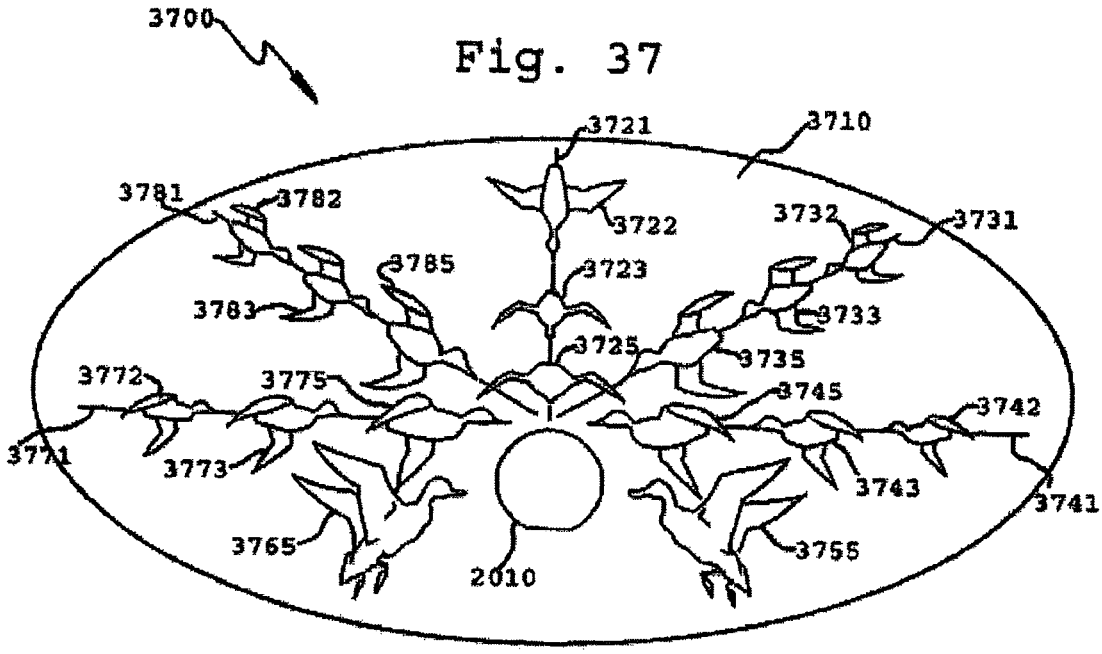
FIG. 37 is front view of a gun sight design 3700.

FIG. 37 is front view of a gun sight design 3700. A plurality of groups of sight indicators are provided on substrate 3710, each sight indicator being an iconic representation of game (such as a duck). In some embodiments, the size of each icon in a group is different, as is the perspective view. Some groups have a single icon, such as icon 3755 and icon 3765, while other groups have a plurality of icons. The group along line 3741 includes icon 3742 for far-away targets, icon 3743 for intermediate-distance targets, and icon 3745 for nearby targets moving right-to-left. The group along line 3731 includes icon 3732 for far-away targets, icon 3733 for intermediate-distance targets, and icon 3735 for nearby targets moving right-to-left from above. The group along line 3721 includes icon 3722, icon 3723, and icon 3725 for targets moving directly away from above. The group along line 3781 includes icon 3782, icon 3783, and icon 3785 for targets moving left-to-right from above. The group along line 3771 includes icon 3772, icon 3773, and icon 3775 for targets moving left-to-right.

Figure 38:
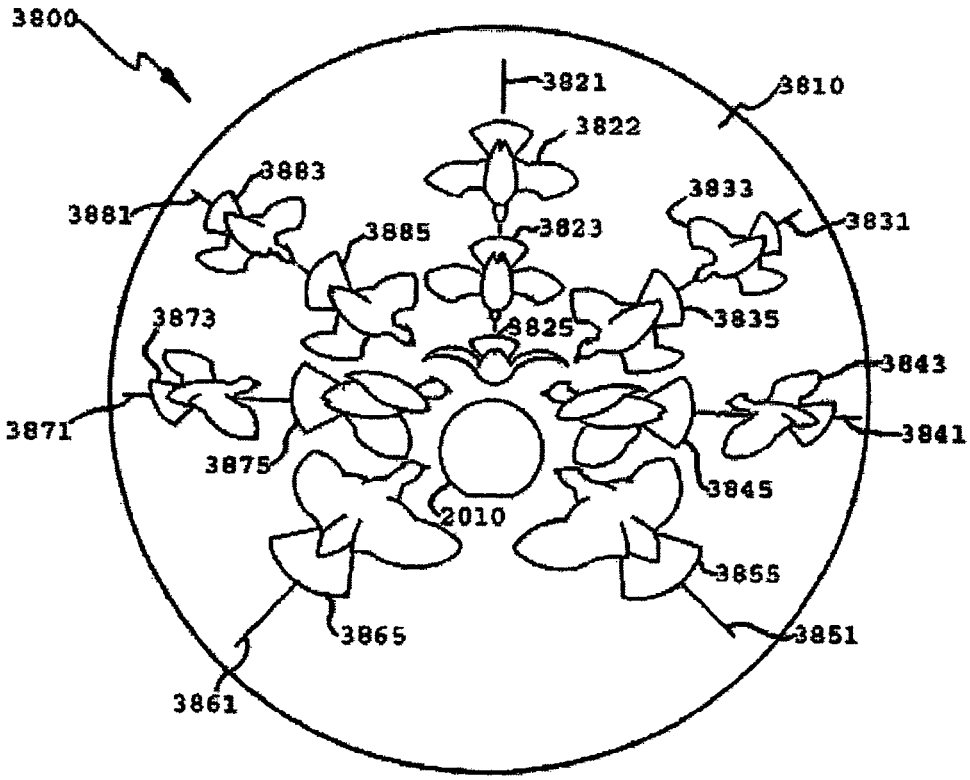
FIG. 38 is front view of a gun sight design 3800.

FIG. 38 is front view of a circular gun sight design 3800. In the embodiment shown, the plurality sight indicators formed on substrate 3810 are iconic representations of a field bird such as a grouse. In some embodiments, the size of each icon in a group is different, as is the perspective view provided of the grouse. Some groups have a single icon, such as icon 3855 and icon 3865, while the other groups have a plurality of icons. The group along line 3841 includes icon 3842 for far-away targets, icon 3843 for intermediate-distance targets, and icon 3845 for nearby targets moving right-to-left. The group along line 3831 includes icon 3832, icon 3833, and icon 3835 for targets moving right-to-left from above. The group along line 3821 includes icon 3822, icon 3823, and icon 3825 for targets moving directly away from above. The group along line 3881 includes icon 3882, icon 3883, and icon 3885 for targets moving left-to-right from above. The group along line 3871 includes icon 3872, icon 3873, and icon 3875 for targets moving left-to-right.

Figure 39:
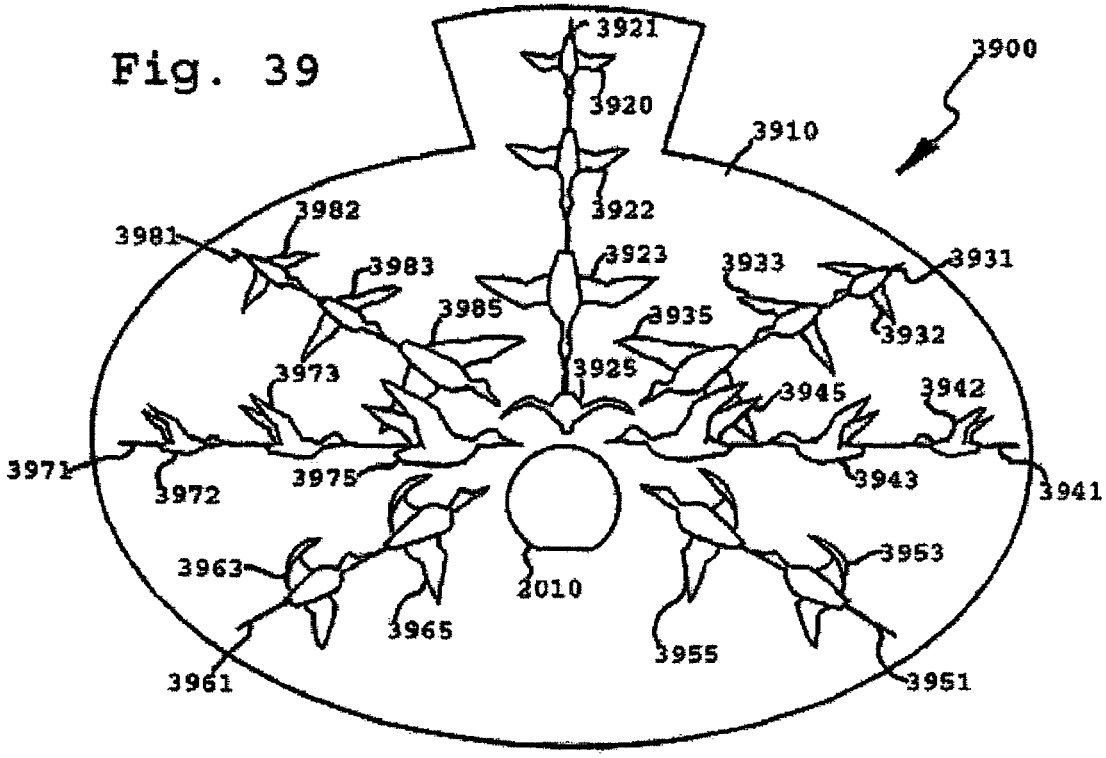
FIG. 39 is front view of a gun sight design 3900.

FIG. 39 is front view of an oval gun sight design 3900 having a top protrusion. In the embodiment shown, the plurality sight indicators formed on substrate 3910 are iconic representations of a waterfowl bird such as a goose or duck. In some embodiments, the size of each icon in a group is different, as is the perspective view provided of the goose. All groups have a plurality of icons. The group along line 3941 includes icon 3942 for far-away targets, icon 3943 for intermediate-distance targets, and icon 3945 for nearby targets moving right-to-left. The group along line 3931 includes icon 3932, icon 3933, and icon 3935 for targets moving right-to-left from above. The group along line 3921 includes icon 3922, icon 3923, and icon 3925 for targets moving directly away from above. The group along line 3981 includes icon 3982, icon 3983, and icon 3985 for targets moving left-to-right from above. The group along line 3971 includes icon 3972, icon 3973, and icon 3975 for targets moving left-to-right. The group along line 3951 includes icon 3953 and icon 3975 for targets moving right-to-left and upwards. The group along line 3961 includes icon 3963 and icon 3965 for targets moving left-to-right and upwards.

Figure 40:
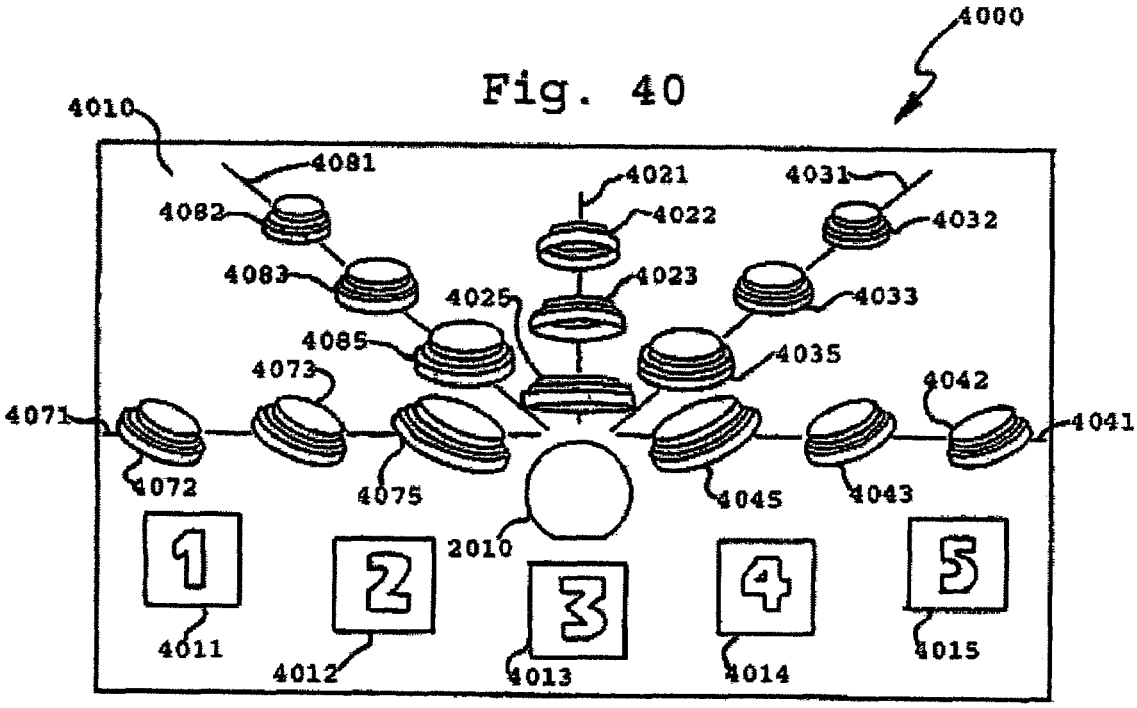
FIG. 40 is front view of a gun sight design 4000.

FIG. 40 is front view of a gun sight design 4000. Substrate 4010 includes iconic representations of inanimate flying objects such as skeet or other clay targets. In some embodiments, the size of each icon in a group is different, as is the perspective view of the target. All groups have a plurality of icons. Further, numbered icons 4011, 4012, 4013, 4014, and 4015 are provided for the various stations at such a shooting range. The group along line 4041 includes icon 4042 for far-away targets, icon 4043 for intermediate-distance targets, and icon 4045 for nearby targets moving right-to-left. The group along line 4031 includes icon 4032, icon 4033, and icon 4035 for targets moving right-to-left from above. The group along line 4021 includes icon 4022, icon 4023, and icon 4025 for targets moving directly away from above. The group along line 4081 includes icon 4082, icon 4083, and icon 4085 for targets moving left-to-right from above. The group along line 4071 includes icons 4072, 4073, and 4075 for targets moving left-to-right.

Figure 41:
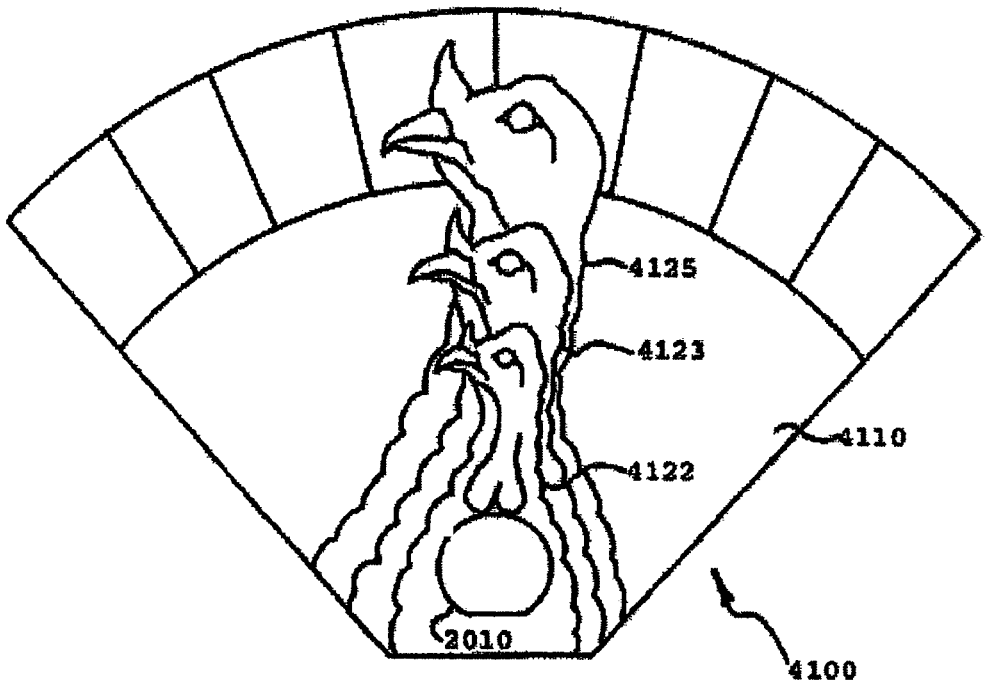
FIG. 41 is front view of a gun sight design 4100.

FIG. 41 is front view of a gun sight design 4100, where substrate 4110 includes iconic representations of stationary game, such as turkeys. For this type of game, typically less than forty yards away, and thus having almost no projectile drop, gun sight 4100 is designed to help the shooter aim for the correct portion of the anatomy. In some embodiments, the size of each icon is different, and the icons are nested within one another. For game that is further away, the shooter must aim at a smaller angle from the top of the target (e.g., to hit the desired point on the neck), and thus the small icon 4122 is situated such that when aligned to a far away turkey target, the barrel of the gun is angled at a smaller angle from the top of the target than when icon 4123 is aligned to an intermediate distance turkey target. The barrel of the gun is angled still lower when icon 4125 is aligned to a nearby target.

Figure 42:
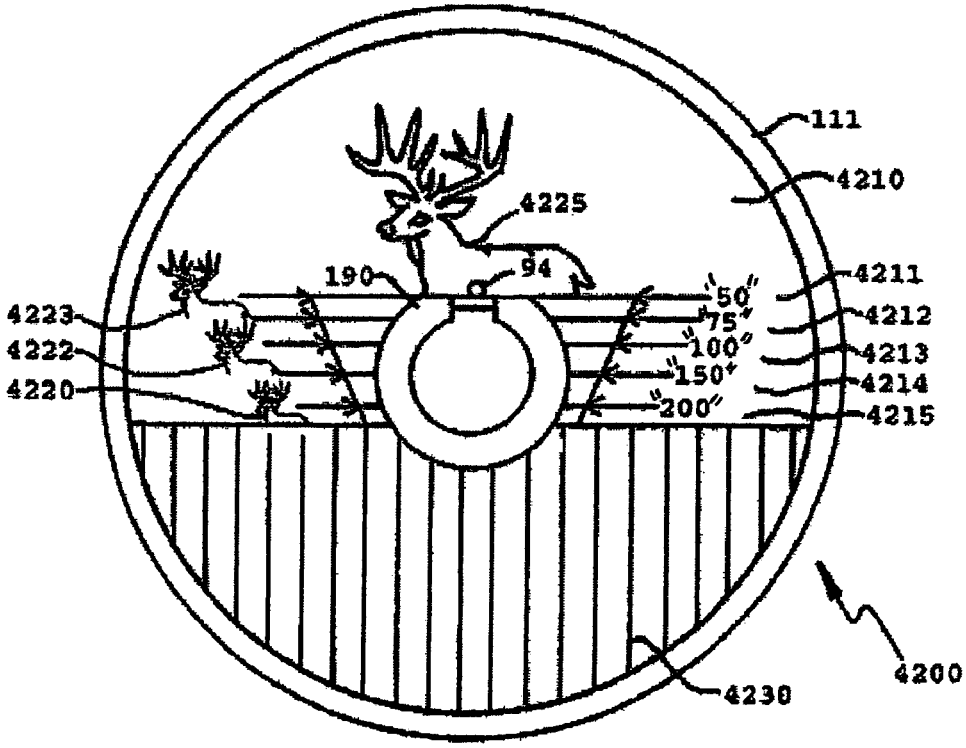
FIG. 42 is front view of a gun sight design 4200.

FIG. 42 is front view of a gun sight design 4200 used for hunting deer, elk, and similar game. Gun sight 4200 helps the shooter compensate for bullet drop over distance. The numbers in quotation marks are printed (or otherwise formed) on substrate 4210 (as numbers, not necessarily having the quotation marks), and do not represent reference numbers of the Figure. A plurality of different-sized game icons, e.g., small icon 4220, intermediate-sized icon 4222, and large icon 4223 are provided for the hunter to align to the game to help judge distance to the game. Further (or alternatively), in some embodiments, a plurality of horizontal lines of different lengths are provided, such as short line 4215, and longer lines 4214, 4213, 4212, and 4211, corresponding respectively to distances of "200," "150," "100," "75," and "50" yards (or meters). The size of each of these lines can be used to help judge distance, and thus the amount of upward angle to provide to the gun barrel when shooting. When the distance has been judged, the bead 94 is aligned to the desired spot on the target (e.g., the heart) as if almost no projectile drop (i.e., as if the target were only 50 yards away). The barrel is then lifted by an amount corresponding to the distance just judged. For example, if the earlier procedure judged the distance to be 150 yards (or meters), the gun would be raised until the "150" line 4214 coincided with where the "50" mark 4211 was when the initial alignment was made, and the shot is taken. Alternatively, the target is aligned to one of the different-sized left-hand icons, and the gun is then moved horizontally at that level until the number of the vertical lines 4230 moved would align the gunbarrel to where the game is. This can be necessary since in some instances the barrel of the gun blocks the view to distant game, and the horizontal lines 4211-4215 allow the shooter to accurately determine how much rise to provide, and the vertical line 4230 help in moving the gun straight up for the first procedure described, or to determine how much side movement to use for the second procedure.

Thus, one aspect of the invention provides a gun sight for attachment to a gunbarrel, the gun sight including a first plurality of sight indicators including a first sight indicator configured to be closer to the gunbarrel, and a second sight indicator, smaller than the first sight indicator and configured to be further from the gunbarrel, both along a first direction that extends from the gunbarrel. In some embodiments, the invention includes a firearm attached to the gun sight. In some such embodiments, the firearm is removably attached to the firearm. In some embodiments, a plurality of different gun sights are provided to be swappable for different shooting situations.

Some embodiments of the gun sight include a second plurality of sight indicators including a fourth sight indicator located to be closer to the gunbarrel, and a fifth sight indicator, smaller than the fourth sight indicator and located to be further from the gunbarrel, both along a second direction that extends from the gunbarrel, a third plurality of sight indicators including a sixth sight indicator located to be closer to the gunbarrel, and a seventh indicator, smaller than the sixth sight indicator and located to be further from the gunbarrel, both along a third direction that extends from the gunbarrel in a direction opposite the second direction, a fourth plurality of sight indicators including an eighth sight indicator located to be closer to the gunbarrel, and a ninth indicator, smaller than the eighth sight indicator and located to be further from the gunbarrel, both along a fourth direction that extends from the gunbarrel in an angled direction between the second direction and the first direction, and a fifth plurality of sight indicators including an tenth sight indicator located to be closer to the gunbarrel, and an eleventh indicator, smaller than the tenth sight indicator and located to be further from the gunbarrel, both along a fifth direction that extends from the gunbarrel in an angled direction between the third direction and the first direction. In some embodiments, the gun sight is configured to be attached to the gunbarrel such that the first direction extends substantially vertically above the gunbarrel, and such that the second direction and third direction both extend substantially horizontally relative to the gunbarrel when the gunbarrel is held in a shooting position.

In some embodiments, the first plurality of sight indicators further includes a third sight indicator configured to be between the first sight indicator and the second sight indicator along the first direction, and having a size between the size of the first sight indicator and the size of the second sight indicator.

In some embodiments, the gun sight is configured to be attached to the gunbarrel such that the first sight indicator and the second sight indicator are both located vertically above the gunbarrel.

Some embodiments of the gun sight include a substantially straight visible first line located substantially along the first direction to show a connection of the first sight indicator to the second sight indicator.

In some embodiments, the first sight indicator and the second sight indicator are formed of a substantially open structure.

In some embodiments, the first sight indicator and the second sight indicator are formed of a wire.

In some embodiments, the first sight indicator and the second sight indicator are formed of an elongated cast material having a low aspect ratio.

In some embodiments, the first sight indicator and the second sight indicator are formed of metal thin enough to substantially not block a view of a target.

In some embodiments, the first sight indicator and the second sight indicator are formed on a transparent substrate.

Some embodiments of the gun sight include a second plurality of sight indicators including a fourth sight indicator located to be closer to the gunbarrel, and a fifth sight indicator, smaller than the fourth sight indicator and located to be further from the gunbarrel, both along a second direction that extends from the gunbarrel.

In some embodiments, the gun sight is configured to be attached to the gunbarrel such that the first direction extends vertically above the gunbarrel, and such that the second direction extends substantially perpendicular to the first direction.

Some embodiments of the gun sight include a third plurality of sight indicators including a sixth sight indicator located to be closer to the gunbarrel, and an seventh indicator, smaller than the sixth sight indicator and located to be further from the gunbarrel, both along a third direction that extends from the gunbarrel in a direction opposite the second direction, and wherein the gun sight is configured to be attached to the gunbarrel such that the first direction extends substantially vertically above the gunbarrel, and such that the second direction and third direction both extend substantially perpendicular to the first direction.

Another aspect of the invention provides a method that includes providing a substantially transparent substrate, configuring the substrate to be attached to a gunbarrel, and affixing to the substrate a first plurality of sight indicators including a first sight indicator located to be closer to the gunbarrel, and a second sight indicator, smaller than the first sight indicator and located to be further from the gunbarrel, both along a first direction that extends from the gunbarrel.

Some embodiments of the method further include affixing to the substrate a third sight indicator at a location between the first sight indicator and the second sight indicator along the first direction, and the third sight indicator having a size between the size of the first sight indicator and the size of the second sight indicator.

In some embodiments, the configuring of the substrate to be attached to gun sight includes configuring such that the first sight indicator and the second sight indicator are located vertically above the gunbarrel.

Some embodiments of the method further include affixing to the substrate a first visible line located to connect the first sight indicator to the second sight indicator.

Some embodiments of the method further include affixing to the substrate a second plurality of sight indicators including a fourth sight indicator located to be closer to the gunbarrel, and a fifth sight indicator, smaller than the fourth sight indicator and located to be further from the gunbarrel, both along a second direction that extends from the gunbarrel, affixing to the substrate a third plurality of sight indicators including a sixth sight indicator located to be closer to the gunbarrel, and a seventh indicator, smaller than the sixth sight indicator and located to be further from the gunbarrel, both along a third direction that extends from the gunbarrel in a direction opposite the second direction, affixing to the substrate a fourth plurality of sight indicators including an eighth sight indicator located to be closer to the gunbarrel, and a ninth indicator, smaller than the eighth sight indicator and located to be further from the gunbarrel, both along a fourth direction that extends from the gunbarrel in an angled direction between the second direction and the first direction, and affixing to the substrate a fifth plurality of sight indicators including an tenth sight indicator located to be closer to the gunbarrel, and an eleventh indicator, smaller than the tenth sight indicator and located to be further from the gunbarrel, both along a fifth direction that extends from the gunbarrel in an angled direction between the third direction and the first direction. In some embodiments, the configuring of the substrate to be attached to gun sight includes configuring such that the first direction extends substantially vertically above the gunbarrel, and such that the second direction and third direction both extend substantially horizontally relative to the gunbarrel when the gunbarrel is held in a shooting position.

Yet another aspect of the invention provides an apparatus that includes a gun sight configured to be attached to a gunbarrel, and means as described above on the gun sight for sighting a target to allow positioning of the gunbarrel to compensate for a distance to the target.

Some embodiments of the apparatus further include means for removably attaching the gun sight to a firearm.

Some embodiments of the apparatus further include a firearm attached to the gun sight.

In some embodiments, the means for sighting the target further comprises a plurality of different-sized indicator means.

In some embodiments, the plurality of different-sized indicator means includes a first plurality of sight indicator means including a first sight indicator means located to be closer to the gunbarrel, and a second sight indicator means, smaller than the first sight indicator means and located to be further from the gunbarrel, both along a first direction that extends substantially vertically from the gunbarrel, a second plurality of sight indicator means including a fourth sight indicator means located to be closer to the gunbarrel, and a fifth sight indicator means, smaller than the fourth sight indicator means and located to be further from the gunbarrel, both along a second direction that extends substantially horizontally from the gunbarrel, a third plurality of sight indicator means including a sixth sight indicator means located to be closer to the gunbarrel, and a seventh indicator means, smaller than the sixth sight indicator means and located to be further from the gunbarrel, both along a third direction that extends substantially horizontally from the gunbarrel in a direction substantially opposite the second direction, a fourth plurality of sight indicator means including an eighth sight indicator means located to be closer to the gunbarrel, and a ninth indicator means, smaller than the eighth sight indicator means and located to be further from the gunbarrel, both along a fourth direction that extends from the gunbarrel in an angled direction between the second direction and the first direction, and a fifth plurality of sight indicator means including an tenth sight indicator means located to be closer to the gunbarrel, and an eleventh indicator means, smaller than the tenth sight indicator means and located to be further from the gunbarrel, both along a fifth direction that extends from the gunbarrel in an angled direction between the third direction and the first direction.

In the foregoing detailed description of embodiments of the invention, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the detailed description of embodiments of the invention, with each claim standing on its own as a separate embodiment. It is understood that the above description is intended to be illustrative, and not restrictive. It is intended to cover all alternatives, modifications and equivalents as may be included within the spirit and scope of the invention as defined in the appended claims. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

What is claimed is:

1. A gun sight for attachment to a gunbarrel of a gun, the gun sight comprising:

a first plurality of sight indicators configured to aim the gunbarrel to compensate for motion of a flying target and a distance to the flying target including a first sight indicator having a first substantially enclosed outline for aligning to an apparent size of flying targets at a closer distance and configured to appear, as viewed, to be at a first displacement from a vertical centerline of the gun corresponding to a first nonzero angle of lead, a second sight indicator having a second substantially enclosed outline for aligning to an apparent size of flying targets at a farther distance, wherein the second sight indicator is smaller than the first sight indicator and configured to be further from the vertical centerline of the gun corresponding to a second nonzero angle of lead larger than the first angle of lead, and wherein both the first sight indicator and the second sight indicator are along a first direction that extends at a nonzero angle from the vertical centerline of the gun, and a third sight indicator configured to be between the first sight indicator and the second sight indicator along the first direction, and having a size between the size of the first sight indicator and the size of the second sight indicator, wherein the gun sight is a non-telescopic gun sight.

2. The gun sight of claim 1, further comprising a second plurality of sight indicators including a fourth sight indicator located to appear, as viewed, to be at a first displacement from the gun, and a fifth sight indicator, smaller than the fourth sight indicator and located to be further from the gun, both located vertically above the gun, and configured to compensate for motion of the flying target moving horizontally away from the gun and from above the gun.

3. The gun sight of claim 2, further comprising a sixth sight indicator configured to be between the fourth sight indicator and the fifth sight indicator vertically above the gunbarrel, having a size between the size of the fourth sight indicator and the size of the fifth sight indicator, and configured to compensate for motion of the flying target moving horizontally away from the gun and from above the gun.

4. The gun sight of claim 1, further comprising a substantially straight visible first line located substantially along the first direction to show a connection of the first sight indicator to the second sight indicator configured to align with a direction of motion of the flying target.

5. The gun sight of claim 4, wherein the first sight indicator and the second sight indicator are formed of a substantially open structure.

6. The gun sight of claim 1, wherein the first sight indicator and the second sight indicator are formed of a wire.

7. The gun sight of claim 1, wherein the first sight indicator and the second sight indicator are formed of an elongated cast material having a low aspect ratio.

8. The gun sight of claim 1, wherein the first sight indicator and the second sight indicator are formed of metal thin enough to substantially not block a view of a target.

9. The gun sight of claim 1, wherein the first sight indicator and the second sight indicator are formed on a transparent substrate.

10. The gun sight of claim 9, wherein the gun sight is configured to be attached to the gunbarrel such that the first direction extends vertically above the gun.

11. The gun sight of claim 1, further comprising:

a third plurality of sight indicators including a seventh sight indicator located to appear, as viewed, to be at a fourth displacement from the vertical centerline of the gun, and a eighth sight indicator, smaller than the seventh sight indicator and located to be further from the vertical centerline of the gun, both along a second direction that extends at a nonzero angle from the vertical centerline of the gun.

12. A gun sight for attachment to a gunbarrel, the gun sight comprising:

a first plurality of sight indicators configured to aim the gunbarrel to compensate for motion of a target including a first sight indicator configured to appear, as viewed, to be closer to the gunbarrel, and a second sight indicator, smaller than the first sight indicator and configured to be further from the gunbarrel, both along a first direction that extends from the gunbarrel;

a second plurality of sight indicators including a fourth sight indicator located to appear, as viewed, to be closer to the gunbarrel, and a fifth sight indicator, smaller than the fourth sight indicator and located to appear, as viewed, to be further from the gunbarrel, both along a second direction that extends from the gunbarrel;

a third plurality of sight indicators including a sixth sight indicator located to appear, as viewed, to be closer to the gunbarrel, and a seventh indicator, smaller than the sixth sight indicator and located to appear, as viewed, to be further from the gunbarrel, both along a third direction that extends from the gunbarrel in a direction opposite the second direction;

a fourth plurality of sight indicators including an eighth sight indicator located to appear, as viewed, to be closer to the gunbarrel, and a ninth indicator, smaller than the eighth sight indicator and located to appear, as viewed, to be further from the gunbarrel, both along a fourth direction that extends from the gunbarrel in an angled direction between the second direction and the first direction; and a fifth plurality of sight indicators including an tenth sight indicator located to appear, as viewed, to be closer to the gunbarrel, and an eleventh indicator, smaller than the tenth sight indicator and located to appear, as viewed, to be further from the gunbarrel, both along a fifth direction that extends from the gunbarrel in an angled direction between the third direction and the first direction; and wherein the gun sight is configured to be attached to the gunbarrel such that the first direction extends substantially vertically above the gunbarrel, and such that the second direction and third direction both extend substantially horizontally relative to the gunbarrel when the gunbarrel is held in a shooting position.

13. The gun sight of claim 12, wherein the first sight indicator, the second sight indicator, the third sight indicator, the fourth sight indicator, the fifth sight indicator, the sixth sight indicator, the seventh sight indicator, the eighth sight indicator, the ninth sight indicator, the tenth sight indicator and the eleventh sight indicator are all outlines in the shape of a game animal.

14. A gun sight for attachment to a gunbarrel the gun sight comprising:

a first plurality of sight indicators configured to aim the gunbarrel to compensate for a distance to the target and motion of a target including a first sight indicator configured to align to an apparent size of closer targets and aim at a first non-zero lead angle closer to the gunbarrel, and a second sight indicator, smaller than the first sight indicator and configured to align to an apparent size of farther targets and aim at a second non-zero lead angle further from the gunbarrel, both along a first direction that extends from the gunbarrel;

a second plurality of sight indicators including a fourth sight indicator located and configured to align to an apparent size of closer targets and aim at a third non-zero lead angle closer to the gunbarrel, and a fifth sight indicator, smaller than the fourth sight indicator and located and configured to align to an apparent size of farther targets and aim at a fourth non-zero lead angle further from the gunbarrel, both along a second direction that extends from the gunbarrel; and a third plurality of sight indicators including a sixth sight indicator located and configured to align to an apparent size of closer targets and aim at a fifth non-zero lead angle closer to the gunbarrel, and an seventh indicator, smaller than the sixth sight indicator and located and configured to align to an apparent size of closer targets and aim at a sixth non-zero lead angle further from the gunbarrel, both along a third direction that extends from the gunbarrel in a direction opposite the second direction, and wherein the gun sight is configured to be attached to the gunbarrel such that the first direction extends substantially vertically above the gunbarrel, and such that the second direction and third direction both extend substantially perpendicular to the first direction.

15. A method comprising:

providing a substantially transparent substrate;

configuring the substrate to be attached to a gunbarrel; and affixing to the substrate a first plurality of sight indicators configured to aim the gunbarrel to compensate for a distance to the target and motion of a target, wherein each of the first plurality of sight indicators includes an indicator with substantially enclosed outline, and substrate and indicators form a non-telescopic gun sight, wherein the plurality of sight indicators include:

a first plurality of sight indicators configured to aim the gunbarrel to compensate for a distance to the target and motion of a target including a first sight indicator configured to align to an apparent size of closer targets and aim at a first non-zero lead angle closer to the gunbarrel, and a second sight indicator, smaller than the first sight indicator and configured to align to an apparent size of farther targets and aim at a second non-zero lead angle further from the gunbarrel, both along a first direction that extends from the gunbarrel;

a second plurality of sight indicators including a fourth sight indicator located and configured to align to an apparent size of closer targets and aim at a third non-zero lead angle closer to the gunbarrel, and a fifth sight indicator, smaller than the fourth sight indicator and located and configured to align to an apparent size of farther targets and aim at a fourth non-zero lead angle further from the gunbarrel, both along a second direction that extends from the gunbarrel; and a third plurality of sight indicators including a sixth sight indicator located and configured to align to an apparent size of closer targets and aim at a fifth non-zero lead angle closer to the gunbarrel, and an seventh indicator, smaller than the sixth sight indicator and located and configured to align to an apparent size of closer targets and aim at a sixth non-zero lead angle further from the gunbarrel, both along a third direction that extends from the gunbarrel in a direction opposite the second direction, and wherein the gun sight is configured to be attached to the gunbarrel such that the first direction extends substantially vertically above the gunbarrel, and such that the second direction and third direction both extend substantially perpendicular to the first direction.

16. The method claim 15, further comprising:

affixing to the substrate a third sight indicator at a location between the first sight indicator and the second sight indicator along the first direction, and the third sight indicator having a size between the size of the first sight indicator and the size of the second sight indicator, affixing to the substrate a eighth sight indicator at a location between the fourth sight indicator and the fifth sight indicator along the second direction, and the eighth sight indicator having a size between the size of the fourth sight indicator and the size of the fifth sight indicator; and affixing to the substrate a ninth sight indicator at a location between the sixth sight indicator and the seventh sight indicator along the third direction, and the ninth sight indicator having a size between the size of the sixth sight indicator and the size of the seventh sight indicator.

17. The method of claim 15, further comprising:

affixing to the substrate a first visible line located to connect the first sight indicator to the second sight indicator.

18. A method comprising:

providing a substantially transparent substrate;

configuring the substrate to be attached to a gunbarrel as a non-telescopic gun sight;

affixing to the substrate a first plurality of sight indicators configured to aim the gunbarrel to compensate for motion of a target including a first sight indicator located to appear, as viewed, to be closer to the gunbarrel, and a second sight indicator, smaller than the first sight indicator and located to be further from the gunbarrel, both along a first direction that extends from the gunbarrel;

affixing to the substrate a second plurality of sight indicators including a fourth sight indicator located to be closer to the gunbarrel, and a fifth sight indicator, smaller than the fourth sight indicator and located to be farther from the gunbarrel, both along a second direction that extends from the gunbarrel;

affixing to the substrate a third plurality of sight indicators including a sixth sight indicator located to be closer to the gunbarrel, and a seventh indicator, smaller than the sixth sight indicator and located to be farther from the gunbarrel, both along a third direction that extends from the gunbarrel in a direction opposite the second direction;

affixing to the substrate a fourth plurality of sight indicators including an eighth sight indicator located to be closer to the gunbarrel, and a ninth indicator, smaller than the eighth sight indicator and located to be further from the gunbarrel, both along a fourth direction that extends from the gunbarrel in an angled direction between the second direction and the first direction; and affixing to the substrate a fifth plurality of sight indicators including an tenth sight indicator located to be closer to the gunbarrel, and an eleventh indicator, smaller than the tenth sight indicator and located to be farther from the gunbarrel, both along a fifth direction that extends from the gunbarrel in an angled direction between the third direction and the first direction; and wherein the configuring of the substrate to be attached to the gunbarrel as the non-telescopic gun sight includes configuring such that the first direction extends substantially vertically above the gunbarrel, and such that the second direction and third direction both extend substantially horizontally relative to the gunbarrel when the gunbarrel is held in a shooting position.

19. An apparatus comprising:

a non-telescopic gun sight configured to be attached to a gunbarrel; and means on the gun sight for sighting a flying target through one of at least three substantially enclosed outlines of differing sizes along a first direction from the gunbarrel, wherein the first direction is a straight linear direction that intersects the gunbarrel, to allow positioning of the gunbarrel to compensate for a distance to the flying target and for a motion of the flying target.

20. The apparatus of claim 19, further comprising means for removably attaching the gun sight to a firearm.

21. The apparatus of claim 19, further comprising a firearm attached to the gun sight.

22. The apparatus of claim 19, wherein the means for sighting the flying target further comprises a plurality of different-sized indicator means along a second direction that is different than the first direction.

23. An apparatus comprising:

a non-telescopic gun sight configured to be attached to a gunbarrel; and means on the gun sight for sighting a target through a substantially enclosed outline to allow positioning of the gunbarrel to compensate for a distance to the target and for a motion of the target, wherein the means for sighting the target further comprises a plurality of different-sized indicator means, and wherein the plurality of different-sized indicator means includes:

a first plurality of sight indicator means including a first sight indicator means located to be closer to the gunbarrel, and a second sight indicator means, smaller than the first sight indicator means and located to be further from the gunbarrel, both along a first direction that extends substantially vertically from the gunbarrel;

a second plurality of sight indicator means including a fourth sight indicator means located to be closer to the gunbarrel, and a fifth sight indicator means, smaller than the fourth sight indicator means and located to be further from the gunbarrel, both along a second direction that extends substantially horizontally from the gunbarrel;

a third plurality of sight indicator means including a sixth sight indicator means located to be closer to the gunbarrel, and a seventh indicator means, smaller than the sixth sight indicator means and located to be further from the gunbarrel, both along a third direction that extends substantially horizontally from the gunbarrel in a direction substantially opposite the second direction;

a fourth plurality of sight indicator means including an eighth sight indicator means located to be closer to the gunbarrel, and a ninth indicator means, smaller than the eighth sight indicator means and located to be further from the gunbarrel, both along a fourth direction that extends from the gunbarrel in an angled direction between the second direction and the first direction; and a fifth plurality of sight indicator means including an tenth sight indicator means located to be closer to the gunbarrel, and an eleventh indicator means, smaller than the tenth sight indicator means and located to be further from the gunbarrel, both along a fifth direction that extends from the gunbarrel in an angled direction between the third direction and the first direction.

24. A gun sight for attachment to a gunbarrel the gun sight comprising:

a first plurality of sight indicators configured to aim the gunbarrel to compensate for motion of a target including a first sight indicator configured to appear, as viewed, to be closer to the gunbarrel, and a second sight indicator, smaller than the first sight indicator and configured to be further from the gunbarrel, both along a first direction that extends from the gunbarrel, wherein each of the first plurality of sight indicators includes an indicator with substantially enclosed outline, and the gun sight is a non-telescopic gun sight; and a clamping system having a fixed portion configured to be held to the gunbarrel and a movable clamp portion configured to clamp the gun sight between the fixed portion and the movable clamp portion.

25. The gun sight of claim 24, wherein the removable clamp portion engages with the fixed portion using mating threads.

26. An apparatus comprising:

an attachment mechanism operable to connect to a firearm having a gunbarrel; and means for compensating for a target distance and motion by directing a horizontal component of aiming relatively further from an axis of the gunbarrel for a further target and relatively closer to the gunbarrel axis for a nearer target via a non-telescopic gun sight, wherein the means for compensating includes:

a first plurality of substantially enclosed sight indicator means including a first sight indicator means located to be closer to the gunbarrel, and a second sight indicator means, smaller than the first sight indicator means and located to be further from the gunbarrel, both along a first direction that extends substantially vertically from the gunbarrel and configured to provide two different nonzero amounts of vertical lead;

a second plurality of substantially enclosed sight indicator means including a fourth sight indicator means located to be closer to the gunbarrel, and a fifth sight indicator means, smaller than the fourth sight indicator means and located to be further from the gunbarrel, both along a second direction that extends substantially horizontally from the gunbarrel and configured to provide two different nonzero amounts of horizontal lead; and a third plurality of substantially enclosed sight indicator means including a sixth sight indicator means located to be closer to the gunbarrel, and a seventh indicator means, smaller than the sixth sight indicator means and located to be further from the gunbarrel, both along a third direction that extends substantially horizontally from the gunbarrel in a direction substantially opposite the second direction and configured to provide two additional different nonzero amounts of horizontal lead.

* * * * *